US007695163B2

(12) United States Patent
Yamada et al.

(10) Patent No.: US 7,695,163 B2
(45) Date of Patent: Apr. 13, 2010

(54) LIGHTING FIXTURE

(75) Inventors: Mitsuo Yamada, Tokyo (JP); Shoichi Banba, Tokyo (JP); Kazuhisa Ui, Tokyo (JP); Teruo Koike, Tokyo (JP); Satoshi Nagasawa, Tokyo (JP); Katsura Tsukada, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 12/197,217

(22) Filed: Aug. 22, 2008

(65) Prior Publication Data

US 2009/0027887 A1 Jan. 29, 2009

Related U.S. Application Data

(63) Continuation of application No. PCT/JP2007/052956, filed on Feb. 19, 2007.

(30) Foreign Application Priority Data

Feb. 22, 2006 (JP) ..... 2006-045160
Mar. 2, 2006 (JP) ..... 2006-056282
Mar. 7, 2006 (JP) ..... 2006-060874

(51) Int. Cl.
*F21V 29/00* (2006.01)

(52) U.S. Cl. ..... 362/294; 362/249.06; 362/373

(58) Field of Classification Search ..... 362/249.04, 362/249.06, 216, 294, 373
See application file for complete search history.

(56) References Cited

U.S. PATENT DOCUMENTS 6,585,395 B2 * 7/2003 Luk ..... 362/249.02
6,942,361 B1 9/2005 Kishimura et al.
7,073,922 B2 * 7/2006 Monjo et al. ..... 362/232
7,196,459 B2 * 3/2007 Morris ..... 313/46
7,210,833 B2 * 5/2007 Gasquet et ..... 362/548
7,237,936 B1 * 7/2007 Gibson ..... 362/547

(Continued)

FOREIGN PATENT DOCUMENTS

JP 1104343 7/1989

(Continued)

OTHER PUBLICATIONS

International Search Report for PCT Patent App. No. PCT/JP2007/052956 (Mar. 13, 2007).

*Primary Examiner*—Stephen F. Husar
*Assistant Examiner*—Peggy A. Neils
(74) *Attorney, Agent, or Firm*—Cermak Kenealy Vaidya & Nakajima LLP

(57) ABSTRACT

Multiple light emitting device modules can be configured to illuminate in multiple different directions, while avoiding deterioration of radiation efficiency by use of fins. In a lighting fixture, multiple light emitting device modules can each have fins for radiating heat generated by the light emitting device. The multiple light emitting device modules can be arranged in such a manner that a main optical axis line of one light emitting device module and main optical axis lines of any other light emitting device modules form an angle larger than zero degrees, or are in a skewed position, and the fins can be arranged in such a manner that all the fins are parallel with respect to a vertical plane and roots of the fins are positioned at the same level as or lower than tips of the fins.

20 Claims, 15 Drawing Sheets

U.S. PATENT DOCUMENTS

| | | | | |
|---|---|---|---|---|
| 7,244,051 | B2 | 7/2007 | Bewig et al. | |
| 7,303,315 | B2 * | 12/2007 | Ouderkirk et al. | 362/294 |
| 7,316,487 | B2 | 1/2008 | Hirata et al. | |
| 2004/0120152 | A1 * | 6/2004 | Bolta et al. | 362/294 |
| 2005/0281033 | A1 * | 12/2005 | Coushaine et al. | 362/294 |

FOREIGN PATENT DOCUMENTS

| | | |
|---|---|---|
| JP | 4018771 | 1/1992 |
| JP | 9293411 | 11/1997 |
| JP | 2002033011 | 1/2002 |
| JP | 2002313119 | 10/2002 |
| JP | 2004055229 | 2/2004 |
| JP | 2004200134 | 2/2004 |
| JP | 2004193002 | 7/2004 |
| JP | 2004259893 | 9/2004 |
| JP | 2004311444 | 11/2004 |
| JP | 2005347279 | 12/2005 |

* cited by examiner (A)

(A)

(B)

(A)

(A)

(B)

(A)

(B)

(C)

FIG. 8
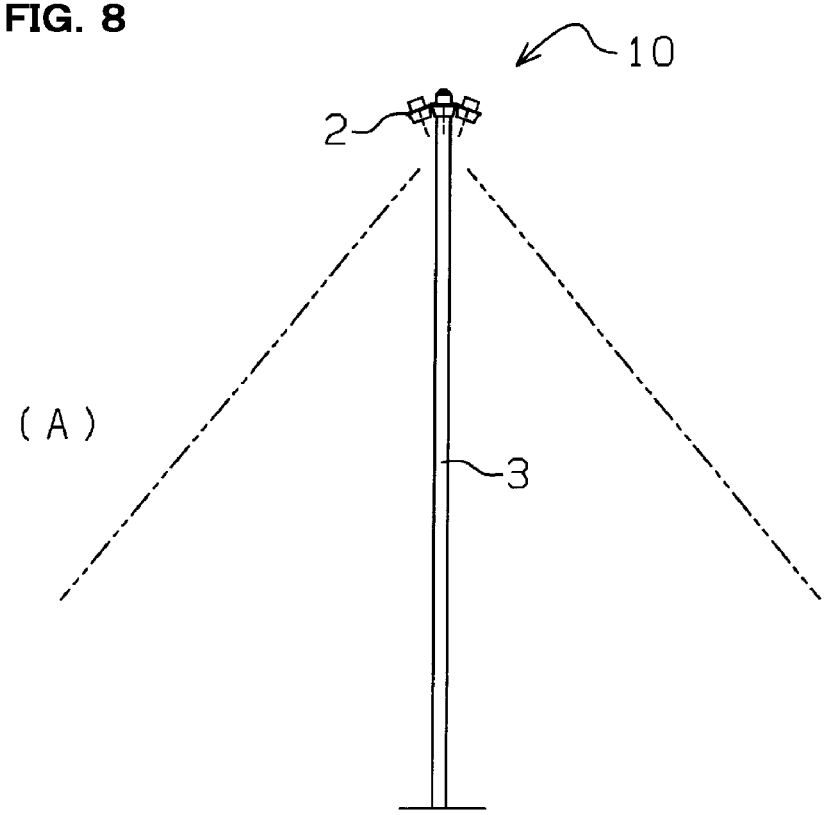
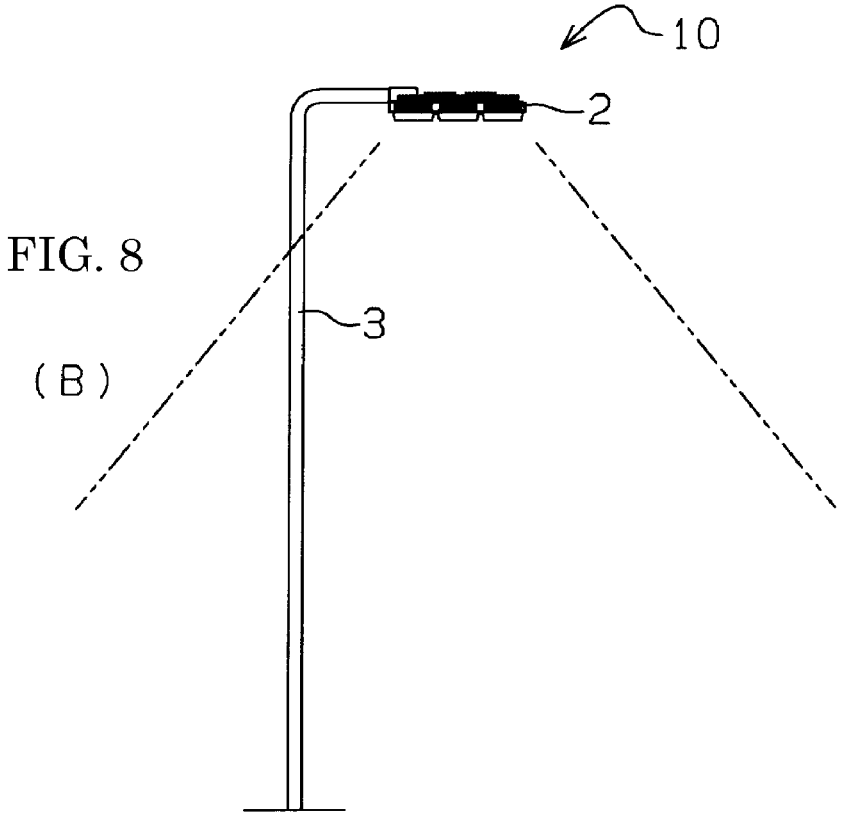
FIG. 8

LIGHTING FIXTURE

This application is a continuation under 35 U.S.C. §120 of PCT Patent Application No. PCT/JP2007/52956, filed on Feb. 19, 2007, and claims the priority benefit under 35 U.S.C. §119 of Japanese Patent Application Nos. 2006-045160, filed on Feb. 22, 2006, and 2006-056282, filed on Mar. 2, 2006, and 2006-060874, filed on Mar. 7, 2006, which are hereby incorporated in their entireties by reference.

BACKGROUND

1. Technical Field

The disclosed subject matter relates to a lighting fixture in which multiple light emitting device modules are provided, each having fins for radiating heat generated by a light emitting device.

2. Description of the Related Art

A lighting fixture described in Japanese Published Unexamined Patent Application No. 2004-55229, for example, is equipped with multiple light emitting device modules (LED light-source modules) each having fins for radiating heat generated by a light emitting device (LED).

In this lighting fixture, the light emitting device (LED) is placed on the same surface as the surface where the fins are placed, among all the surfaces of a bridging part (base) for bridging roots of adjacent fins, and a housing of the lighting fixture is made to abut against the surface opposite to the surface where the fins are arranged. As a result, the heat generated from the light emitting device (LED) is radiated from the fins via the bridging part (base), and the heat is also conducted to the housing of the lighting fixture via the bridging part (base).

In the lighting fixture described in FIG. 9 of Japanese Published Unexamined Patent Application No. 2004-55229, multiple light emitting device modules (LED light source modules) are provided, and those multiple light emitting device modules are arranged in such a manner that a main optical axis line of one light emitting device module is parallel to the main optical axis of other light emitting device modules. Therefore, the light from the multiple light emitting device modules does not illuminate in multiple different directions.

If the direction of the main optical axis line of the multiple light emitting device modules is changed in order to make the multiple light emitting device modules illuminate in multiple different directions, however, an ascending air current which receives heat from the fins may be obstructed, and thereby an efficiency of the heat radiation by the fins may be reduced.

SUMMARY

In view of the above described features, characteristics, problems, and drawbacks, one of the various aspects of the disclosed subject matter is to provide a lighting fixture which allows illumination from the light emitting device modules at wide angle and in multiple different directions, while avoiding the deterioration of efficiency of the heat radiation by the fins.

Accordingly, another aspect of the disclosed subject matter includes providing a lighting fixture with multiple light emitting device modules each including a light emitting device and fins for radiating heat generated by the light emitting device, wherein, all (or a portion of, or substantial portion of) the multiple light emitting device modules are arranged in such a manner that a main optical axis line of one light emitting device module and a main optical axis line of other light emitting device module forms an angle larger than zero degrees, or those main optical axis lines are in a skewed position relative to each other, and all (or a portion of, such as a substantial portion of) the fins are arranged in such a manner that the fins are parallel with respect to a vertical plane and roots of the fins are located at the same height as or lower than tips of the fins.

The inventors of the disclosed subject matter zealously studied at what part a covering layer is to be formed on a surface of a heat radiation member for radiating the heat generated by the light emitting device, in order to enhance efficiency at a maximum in cooling the light emitting device by the heat radiation member.

As a result of the studies, the present inventors have found the following: when the covering layer is formed on a part exposed to the air on the surface of the heat radiation member, the efficiency of the heat radiation from the heat radiation member toward the air can be improved, resulting in greater efficiency for cooling the light emitting device by the heat radiation member. However, when the covering layer is formed on a part that is in contact with the light emitting device on the surface of the heat radiation member, heat transfer resistance between the light emitting device and the heat radiation member is increased, resulting in a reduction or stagnation of efficiency for cooling the light emitting device by the heat radiation member.

In brief, the present inventors have found that the efficiency for cooling the light emitting device by the heat radiation member can be enhanced when the covering layer is not formed at the part which is in contact with the light emitting device on the surface of the heat radiation member.

In addition, the present inventors have found that if polishing is performed at a part which comes into contact with the light emitting device on the surface of the heat radiation member, rather than leaving the part as an unpolished solid surface, the heat transfer resistance can be reduced, resulting in greater efficiency for cooling the light emitting device by the heat radiation member.

In particular, the present inventors have found that if a grease-like or a sheet-like thermally conductive interface material is placed on the part which comes into contact with the light emitting device on the surface of the heat radiation member, rather than leaving the part as an untreated solid surface, the heat transfer resistance can be reduced, resulting in greater efficiency for cooling the light emitting device by the heat radiation member.

Furthermore, the present inventors zealously studied the cooling efficiency of the light emitting device, not only in the case where the light emitting device is directly connected with the heat radiation member but also in the case where the light emitting device is connected with the heat radiation member via the heat transfer member.

As a result of the study, the present inventors have found that when a covering layer is formed at a part which is exposed to the air on the surface of the heat transfer member, the heat radiation efficiency from the heat transfer member into the air can be enhanced, resulting in that the efficiency for cooling the light emitting device by the heat transfer member may be improved. That is, the heat transfer member is found to function as the heat radiation member.

In addition, as a result of the study, the present inventors have found that if the covering layer is formed on a part which is in contact with the light emitting device and on a part which is in contact with the heat radiation member, on the surface of the heat transfer member, the heat transfer resistance is increased, resulting in reduced efficiency for cooling the light emitting device.

In other words, the present inventors have found that it is better not to form the covering layer at the part being in contact with the light emitting device and at the part being in contact with the heat radiation member, on the surface of the heat transfer member, in order to enhance the efficiency for cooling the light emitting device.

In addition, the present inventors have found that if polishing is performed at the part being in contact with the light emitting device and the part that is in contact with the heat radiation member, on the surface of the heat transfer member, rather than leaving the parts as unpolished solid surfaces, the heat transfer resistance can be reduced, resulting in greater efficiency for cooling the light emitting device by the heat radiation member.

Furthermore, the present inventors have found that if the thermally conductive interface material is placed at the part in contact with the light emitting device and at the part in contact with the heat radiation member, on the surface of the heat transfer member, rather than leaving the parts as untreated solid surfaces, the heat transfer resistance can be reduced, resulting in greater efficiency for cooling the light emitting device by the heat radiation member.

In addition, based on the same concept as described above, the present inventors zealously studied which part is to be subjected to a roughening process on the surface of the heat radiation member for radiating the heat generated by the light emitting device, in order to enhance the efficiency at a maximum, in cooling the light emitting device by the heat radiation member.

As a result of the studies, the present inventors have found the following: when the roughening process is performed at the part exposed to the air on the surface of the heat radiation member, the efficiency of the heat radiation from the heat radiation member towards the air can be improved, resulting in greater efficiency for cooling the light emitting device by the heat radiation member. However, when the roughening process is performed at the part in contact with the light emitting device on the surface of the heat radiation member, a heat transfer resistance between the light emitting device and the heat radiation member is increased, resulting in reduced efficiency for cooling the light emitting device by the heat radiation member.

In brief, the present inventors have found that it is better not to perform the roughening process at the part in contact with the light emitting device on the surface of the heat radiation member, in order to enhance the efficiency for cooling the light emitting device by the heat radiation member.

In an exemplary lighting fixture according to the disclosed subject matter, multiple light emitting device modules can be arranged in such a manner that a main optical axis line of one light emitting device module and a main optical axis line of other light emitting device module form an angle of larger than zero degree, or those main optical axis lines are in skew position. Therefore, the multiple light emitting device modules are allowed to illuminate in multiple different directions.

There are the following problems: when the fins are placed at an angle larger than zero degrees with respect to the vertical plane, an ascending air current in the lower side of the fins, which receives heat from the fins, is obstructed by the fins, and an efficiency of heat radiation by the fins may be deteriorated. When the fins are arranged in such a manner that the roots of the fins are located at higher lever than the tips of the fins, the bridging part for bridging the roots of adjacent fins may obstruct the ascending air current that receives the heat from the fins, resulting in reduction of heat radiation efficiency by the fins.

In the lighting fixture according to the disclosed subject matter, all (or a portion of, such as a substantial portion of) the fins can be arranged in such a manner that the fins are parallel with respect to the vertical plane, and the roots of the fins are located at the same height as or lower level than the tips of the fins. It should be noted that a substantial portion can be considered to be more than half, and can even be considered more than 90%, 95% or 98%. Therefore, the above problems and characteristics can be addressed, and accordingly, deterioration the efficiency of heat radiation by the fins can be avoided.

In brief, the lighting fixture of the disclosed subject matter allows the multiple light emitting device modules to illuminate in multiple different directions, while avoiding deterioration of radiation efficiency by the fins.

In order that the fins become parallel with respect to the vertical plane, and the roots of the fins are positioned at the same height as or at a lower level than the tips of the fins, the light emitting device modules may have to be turned around (rotated) for installation occasionally.

However, in a case that a light distribution pattern of the light emitting device module is formed in a polygonal shape, if the light emitting device module is rotated, there is a possibility that a position where light from the light emitting device module is displaced from a target position, and thus the light is not aimed correctly.

In order to attempt to solve this displacement or incorrect aiming problem, a light-distribution pattern of the light emitting device module can be formed in an approximate circular shape whose center is located at the main optical axis line of the light emitting device module.

In such a lighting fixture, one light emitting device of approximately circular shape is provided in each of the light emitting device module. Alternatively, at least two light emitting devices can be arranged on the circle whose center is located at the main optical line axis of the light emitting device module.

Specifically, the light-distribution pattern of the light emitting device module can be formed in an approximately circular shape whose center is located at the main optical axis line of the light emitting device module, so that a position where the light from the light emitting device module reaches is not changed, even when the light emitting device module is turned around. Accordingly, it is possible to reduce the possibility that the position where the light from the light emitting device module is displaced from the target position, along with rotation of the light emitting device module.

A covering layer of an exemplary lighting fixture can be formed on a part exposed to the air on the surface of the heat radiation member for radiating the heat generated by the light emitting device. Therefore, it is possible to enhance the heat radiation efficiency from the part exposed to the air on the surface of the heat radiation member into the air, whereby the efficiency for cooling the light emitting device by the heat radiation member can be enhanced.

The covering layer can also be configured such that it is not formed on a part that is in contact with something other than air, on the surface of the heat radiation member for radiating the heat generated by the light emitting device. Therefore, it is possible to avoid the deterioration of the efficiency for cooling the light emitting device by the heat radiation member, the deterioration being caused by the increase of heat transfer resistance between the thing other than air and the heat radiation member, if the covering layer is formed at the part in contact with the thing other than the air on the surface of the heat radiation member. The heat transfer resistance between the thing other than the air and the heat radiation member can be further reduced, as compared to the case where the covering layer is formed at the part being in contact with the thing other than the air on the surface of the heat radiation member. Therefore, it is possible to enhance the efficiency for cooling the light emitting device by the heat radiation member.

It is also possible to reduce the heat transfer resistance between the thing other than the air and the heat radiation member, while enhancing the efficiency of radiation from the part exposed to the air on the surface of the heat radiation member, into the air.

A roughening process can be performed at the part exposed to the air on the surface of the heat radiation member for radiating the heat generated by the light emitting device. Accordingly, the radiation efficiency from the part exposed to the air on the surface of the heat radiation member into the air, can be enhanced, thereby enhancing the efficiency for cooling the light emitting device by the heat radiation member.

Furthermore, the roughening process may not be performed at the part that is in contact with something other than the air, on the surface of the heat radiation member for radiating the heat generated by the light emitting device. Therefore, it is possible to avoid the deterioration of the efficiency for cooling the light emitting device by the heat radiation member, the deterioration being caused by the increase of heat transfer resistance between the thing other than the air and the heat radiation member, if the roughening process is performed at the part in contact with the thing other than the air on the surface of the heat radiation member. The heat transfer resistance between the thing other than the air and the heat radiation member can be further reduced, as compared to the case where the roughening process is performed at the part being in contact with the thing other than the air on the surface of the heat radiation member. Accordingly, the efficiency for cooling the light emitting device by the heat radiation member can be enhanced.

In brief, it is possible to reduce the heat transfer resistance between the thing other than the air and the heat radiation member, while enhancing the radiation efficiency from the part exposed to the air on the surface of the heat radiation member, into the air.

In addition, the part which is in contact with a thing other than the air can be polished, on the surface of the heat radiation member for radiating the heat generated by the light emitting device. Accordingly, the heat transfer resistance between the thing other than the air and the heat radiation member can be reduced, resulting in that the efficiency for cooling the light emitting device by the heat radiation member is more enhanced, as compared to the case where the part in contact with the thing other than the air on the surface of the heat radiation member is left as an unpolished solid surface.

A thermally conductive interface material can be placed at the part which is in contact with a thing other than the air, on the surface of the heat radiation member for radiating the member generated by the light emitting device. Accordingly, the heat transfer resistance can be reduced, resulting in that the efficiency for cooling the light emitting device by the heat radiation member is more enhanced, than the case where the part in contact with the thing other than the air on the surface of the heat radiation member is left as an untreated solid surface.

According to another aspect, a connecting member can be configured to connect a light emitting device feeding electrode for feeding the light emitting device, with an external electrode, within a space, not sealed by resin. This configuration allows a thermal stress applied to the connecting member to be reduced to a greater degree than the case where the connecting member is sealed by resin.

Furthermore, the connecting member can be constrained in such a manner that, out of the two terminals, one terminal connected to the light emitting device feeding electrode serves as a fixed end and another terminal connected to the external electrode serves as a free end. In other words, the connecting member is constrained in such a manner as substantially forming a cantilever structure. Accordingly, it is possible to reduce the thermal stress applied to the connecting member more than the case where both the terminal connected to the light emitting device feeding electrode and the terminal connected to the external electrode are configured as fixed ends, i.e., the connecting member is constrained to substantially form a fixed beam structure.

That is, in the lighting fixture of the disclosed subject matter, it is possible that only the terminal connected to the light emitting device feeding electrode is constrained, out of the two terminals of the connecting member, and the other part is not constrained. Therefore, even when the temperature of the connecting member is raised along with the heat generation by the light emitting device, a thermal stress is not applied to the connecting member, thereby enabling free thermal expansion of the connecting member.

In other words, the thermal stress applied to the connecting member is reduced, and thereby reliability can be enhanced.

In accordance with another aspect of the disclosed subject matter, the heat radiation member for radiating the heat generated by the light emitting device can be arranged at a position closer to the light emitting device, than the light emitting device feeding electrode. This configuration enables a reduction of the thermal stress applied to the connecting member, as compared to the configuration in which the heat radiation member for radiating the heat generated by the light emitting device is located more distant from the light emitting device, than the light emitting device feeding electrode.

An adhesive agent can be employed for fixing the light emitting device onto the heat radiation member, and an anti-running member can be provided for preventing the adhesive agent from flowing out from between the light emitting device and the heat radiation member. Accordingly, it is possible to avoid the scenario in which the adhesive agent, which flows out from between the light emitting device and the heat radiation member, reaches the light emitting device feeding electrode.

A flexible substrate can be employed as the connecting member. An elongate hole is provided on the flexible substrate for guiding the flexible substrate toward the external electrode. Then, a protrusion that is slidable within the elongate hole of the flexible substrate is provided, thereby allowing the flexible substrate to be guided toward the side of the external electrode, while suppressing the thermal stress application to the flexible substrate.

BRIEF DESCRIPTION OF THE DRAWINGS

FIGS. 8(A)&(B) are overall views of a lighting fixture according to the first embodiment;

DETAILED DESCRIPTION OF EXEMPLARY EMBODIMENTS

Hereinafter, a lighting fixture according to various embodiments of the disclosed subject matter will be explained with reference to the Figures.

Figure 1:
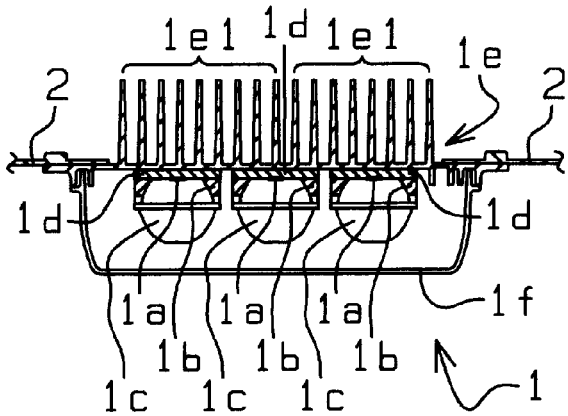
FIGS. 1(A)-(D) illustrate a light emitting device module constituting a part of the lighting fixture according to a first embodiment.
Figure 1:
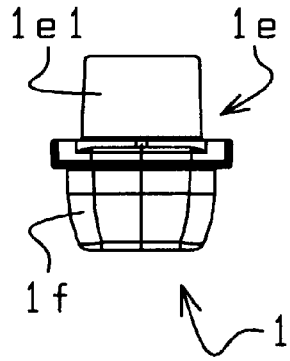
Figure 1:
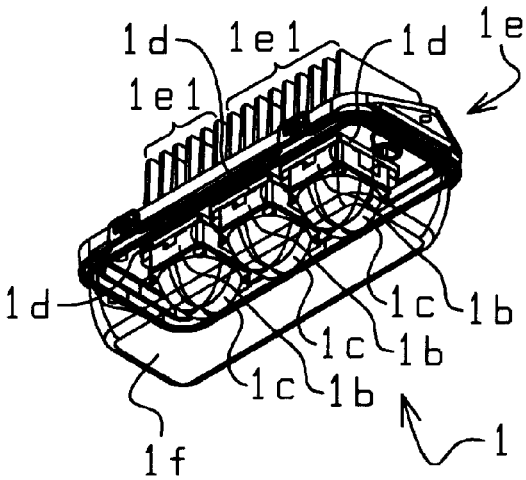
Figure 1:
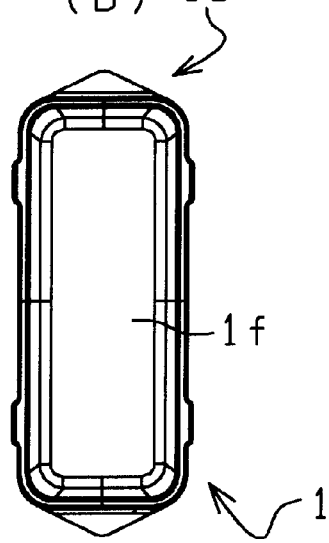

FIG. 1 illustrates a light emitting device module 1 which constitutes a part of the lighting fixture according to a first embodiment of the disclosed subject matter. In particular, FIG. 1(A) is a left side view of the light emitting device module 1, and a partial sectional view, FIG. 1(B) is a front view of the light emitting device module 1, FIG. 1(C) is a perspective view from the front, left and lower side, and FIG. 1(D) is a bottom view of the light emitting device module 1.

In FIG. 1, the reference numeral 1*a* indicates a light emitting device such as an LED, for instance. The reference numeral 1*b* indicates a reflector provided with a reflection surface for reflecting the light emitted from the light emitting device 1*a* downwardly (toward the lower side in FIG. 1(A) and FIG. 1(B)). The reference numeral 1*c* indicates a lens mounted on the reflector 1*b* for controlling a light distribution of the light directly from the light emitting device 1*a* and the light reflected from the reflection surface of the reflector 1*b*.

In FIG. 1, the reference numeral 1*d* indicates a thermal interface material for supporting the light emitting device 1*a* and the reflector 1*b*, and for radiating or conducting the heat generated by the light emitting device 1*a*. The reference numeral 1*e* indicates housing for supporting the thermal interface material 1*d*. The reference numeral 1*e*1 indicates a fin which constitutes a part of the housing 1*e*. The reference numeral 1*f* indicates a cover for covering the light emitting device 1*a*, the reflector 1*b*, the lens 1*c*, and the thermal interface material 1*d*. The reference numeral 2 indicates an installation member for mounting the light emitting device 1 thereon.

In the lighting fixture according to the first embodiment, a part of the heat generated by the light emitting device 1*a* is radiated from the thermal interface material 1*d*. In addition, a part of the heat generated from the light emitting device 1*a* is thermally conducted to the fin 1*e*1 of the housing 1*e*, via the thermal interface material 1*d*, and the heat is radiated from the fin 1*e*1. Furthermore, a part of the heat generated from the light emitting device 1*a* is thermally conducted to the installation member 2, via the thermal interface material 1*d* and the housing 1*e*, and the heat is radiated from the installation member 2.

Figure 2:
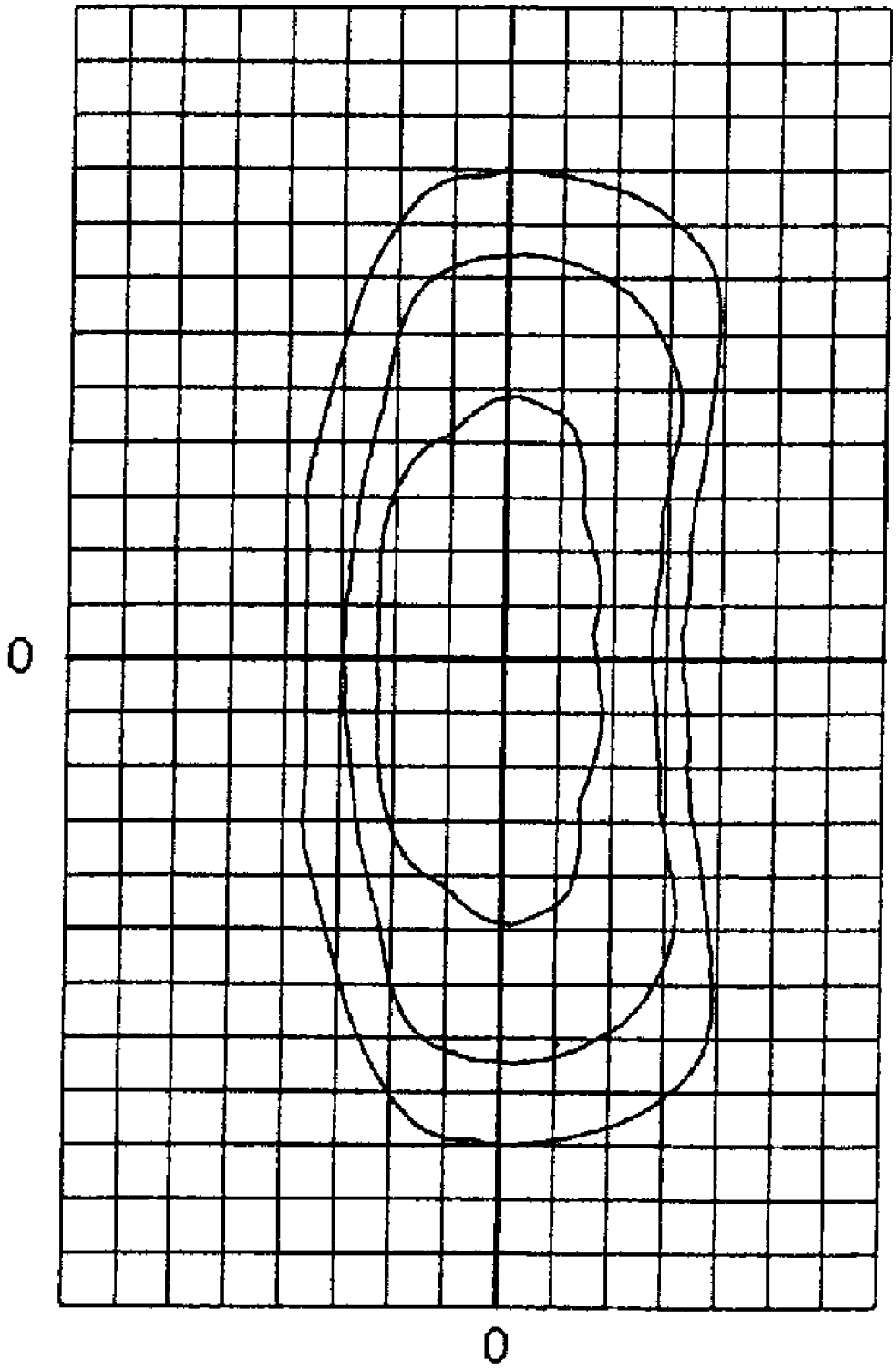
FIG. 2 illustrates a light distribution pattern of the light emitted from the light emitting device module shown in FIG. 1.

FIG. 2 illustrates a light distribution pattern, which is emitted from the light emitting device module 1 as shown in FIG. 1. The left side of FIG. 2 corresponds to the rear side (lower-left side of FIG. 1(C)) of the light emitting device module 1 shown in FIG. 1, and the right side of FIG. 2 corresponds to the front side (upper-right side of FIG. 1(C)) of the light emitting device module 1 shown in FIG. 1. The upper side of FIG. 2 corresponds to the right side (lower-right side of FIG. 1(C)) of the light emitting device module 1 as shown in FIG. 1, and the left side of FIG. 2 corresponds to the left side (upper-left side of FIG. 1(C)) of the light emitting device module shown in FIG. 1.

In the lighting fixture of the first embodiment, as shown in FIG. 1 and FIG. 2, a converging property of the lens 1*c* is configured in such a manner that a degree of light convergence of the light emitting device module 1 in the lateral direction (in the front-rear direction of FIG. 1(A), lateral direction of FIG. 1(B), upper left-lower right direction of FIG. 1(C), lateral direction of FIG. 1(D), and upper-lower direction of FIG. 2) is smaller than the degree of light convergence of the light emitting device module 1 in the longitudinal direction (in the lateral direction of FIG. 1(A), the front-rear direction of FIG. 1(B), upper right-lower left direction of FIG. 1(C), upper-lower direction of FIG. 1(D), and lateral direction of FIG. 2).

In other words, in the light fixture of the first embodiment, as shown in FIG. 2, the light distribution pattern emitted from the light emitting device module 1 can be longer in the lateral direction (upper-lower direction in FIG. 2) than in the longitudinal direction (lateral direction in FIG. 2).

Figure 3:
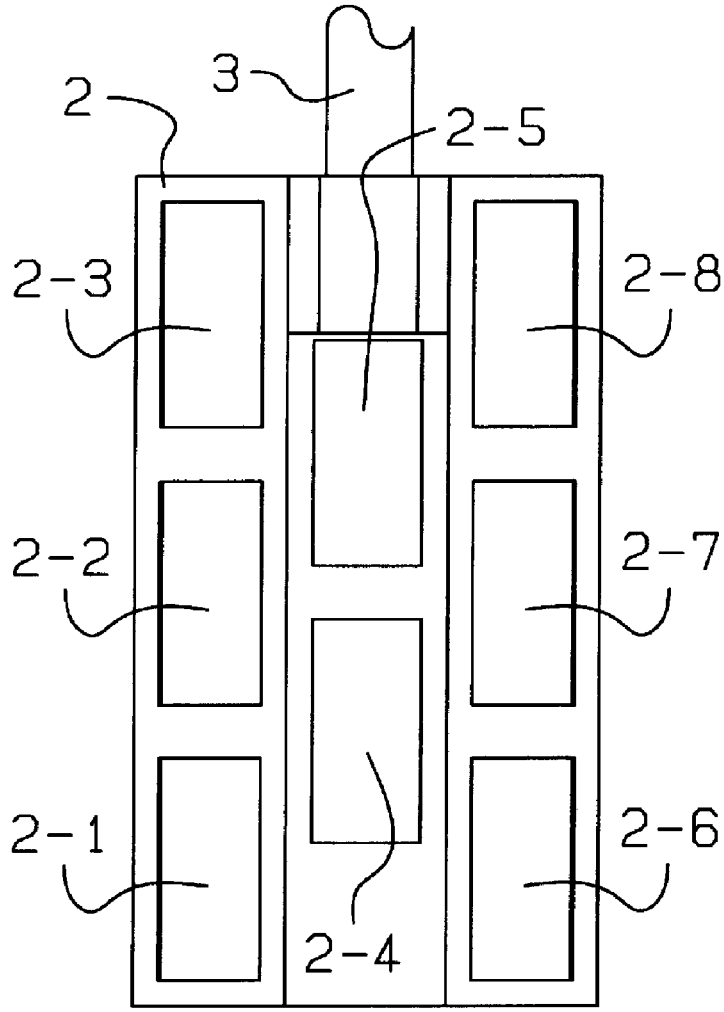
FIGS. 3(A)&(B) illustrate an installation member on which the light emitting device modules shown in FIG. 1 are mounted, and a part of a support for supporting the installation member.
Figure 3:
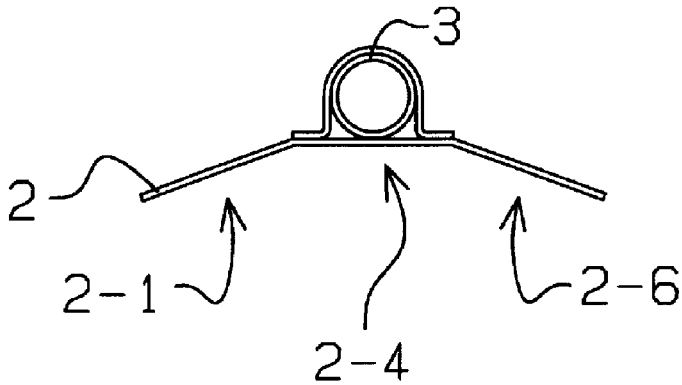
Figure 4:
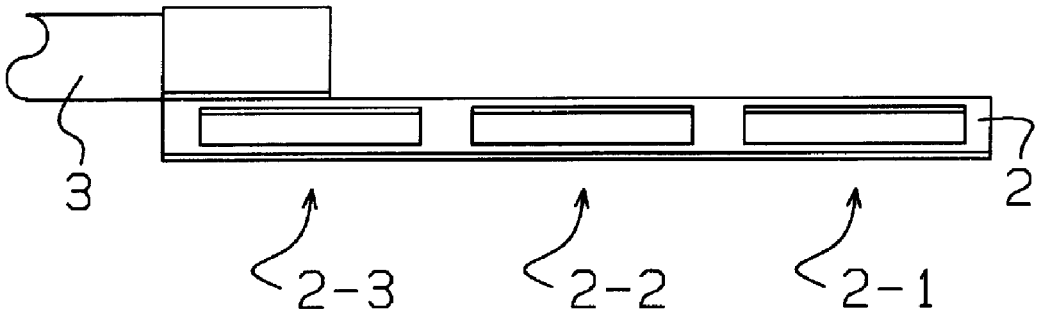
FIGS. 4(A)&(B) illustrate an installation member, on which the light emitting device modules shown in FIG. 1 are mounted, and a part of the support for supporting the installation member.
Figure 4:
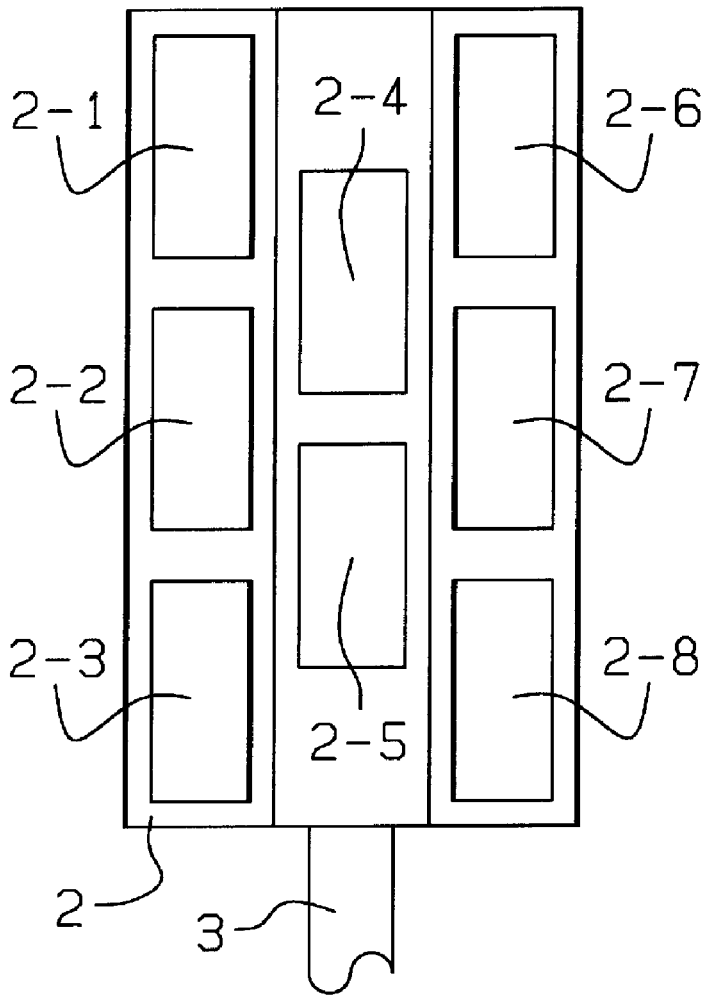

FIG. 3 and FIG. 4 illustrate the installation member 2, on which multiple light emitting device modules 1, one of which is shown in FIG. 1, are mounted, and a support 3 for supporting the installation member 2. In detail, FIG. 3(A) is a plan view of the installation member 2 and a part of the support 3, FIG. 3(B) is a front view of the installation member 2 and a part of the support 3, FIG. 4(A) is a left side view of the installation member 2 and a part of the support 3, and FIG. 4(B) is a bottom view of the installation member 2 and a part of the support 3.

In the lighting fixture according to the first embodiment, as shown in FIG. 3(A) and FIG. 3(B), the installation member 2 is divided into eight partitions, 2-1, 2-2, 2-3, 2-4, 2-5, 2-6, 2-7, and 2-8. In particular, as shown in FIG. 3(A) and FIG. 3(B), the partitions 2-1, 2-2, and 2-3, the partitions 2-4 and 2-5, and the partitions 2-6, 2-7, and 2-8 are bent in two stages.

Figure 5:
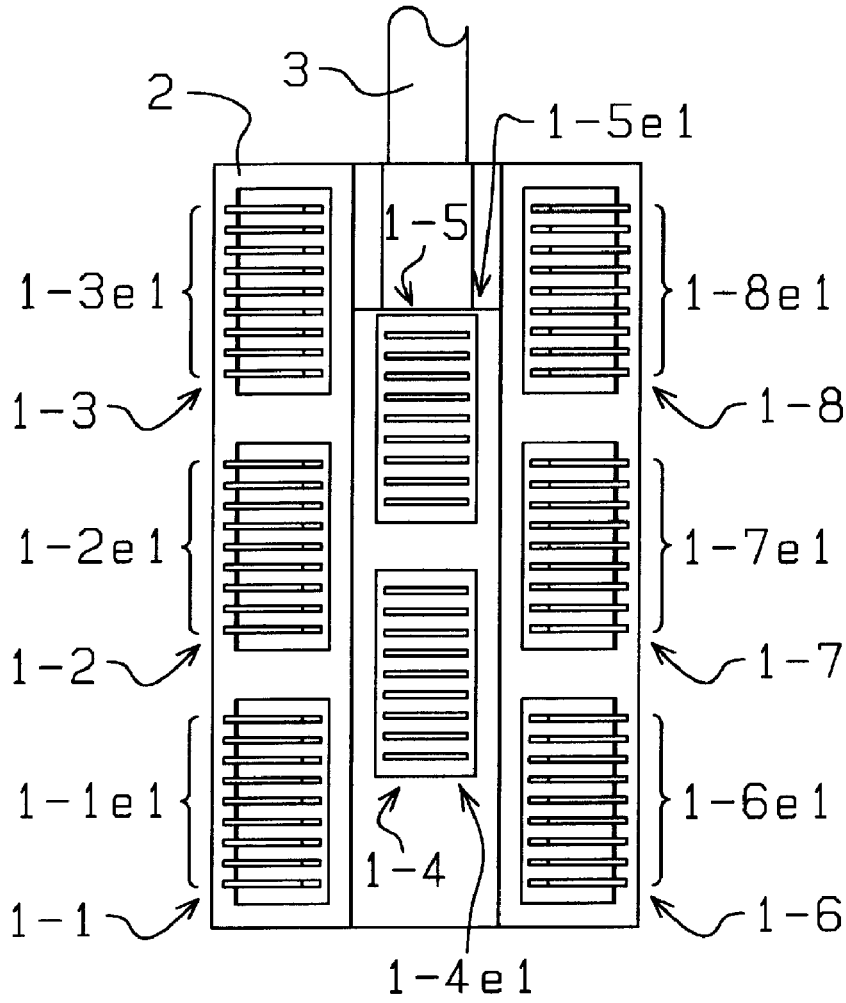
FIGS. 5(A)&(B) illustrate eight light emitting device modules as shown in FIG. 1 mounted on the installation member as shown in FIG. 3 and FIG. 4.
Figure 5:
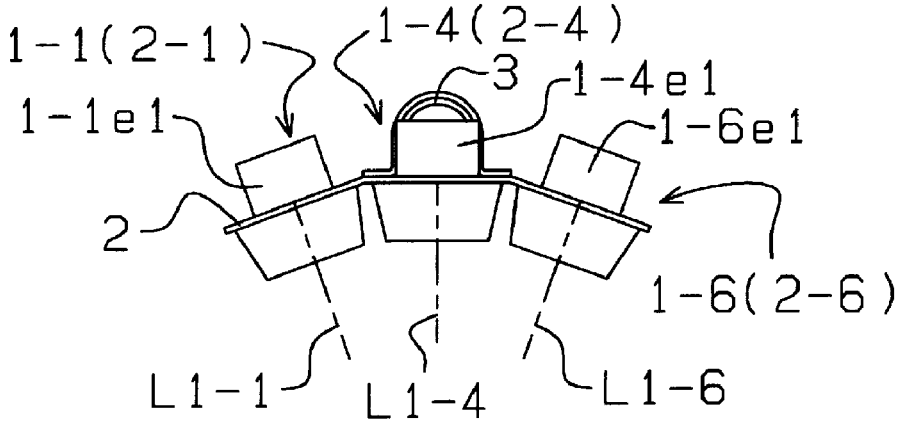
Figure 6:
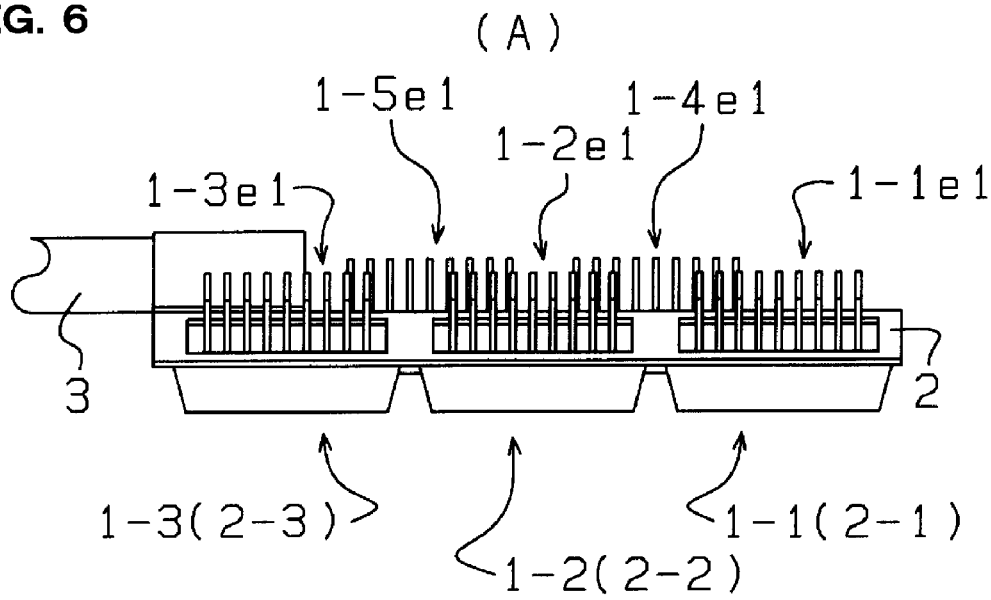
FIGS. 6(A)&(B) illustrate eight light emitting device modules as shown in FIG. 1 mounted on the installation member shown in FIG. 3 and FIG. 4.
Figure 6:
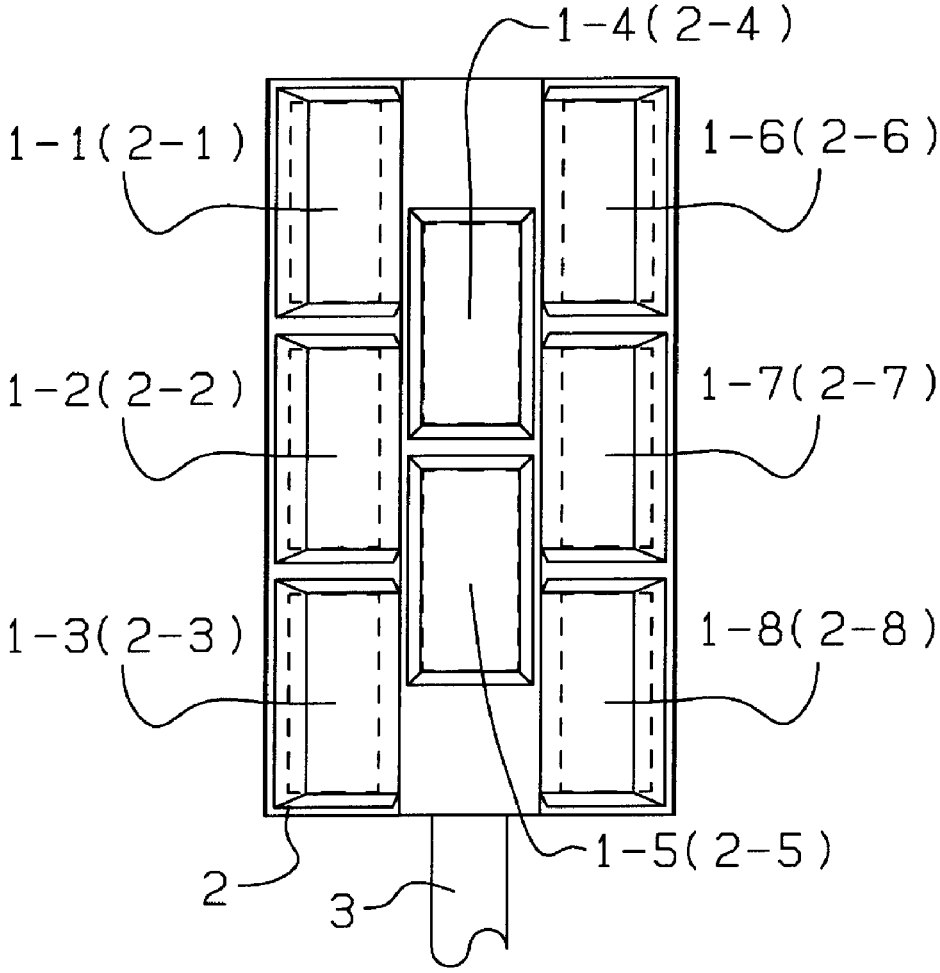
Figure 7:
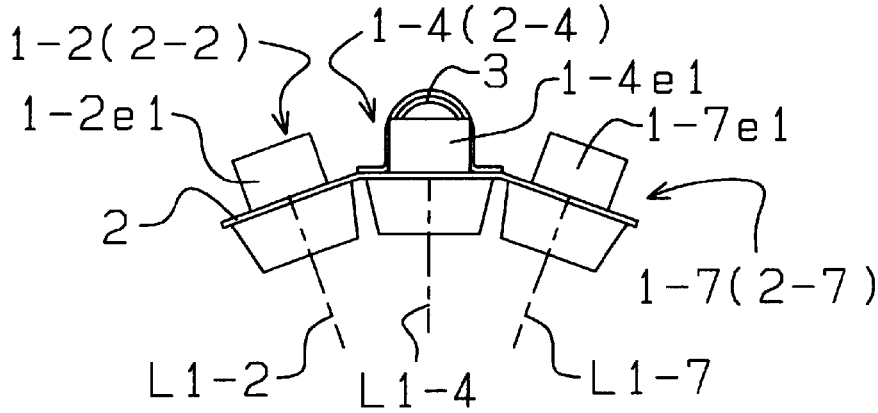
FIGS. 7(A)-(C) illustrate eight light emitting device modules as shown in FIG. 1 mounted on the installation member shown in FIG. 3 and FIG. 4.
Figure 7:
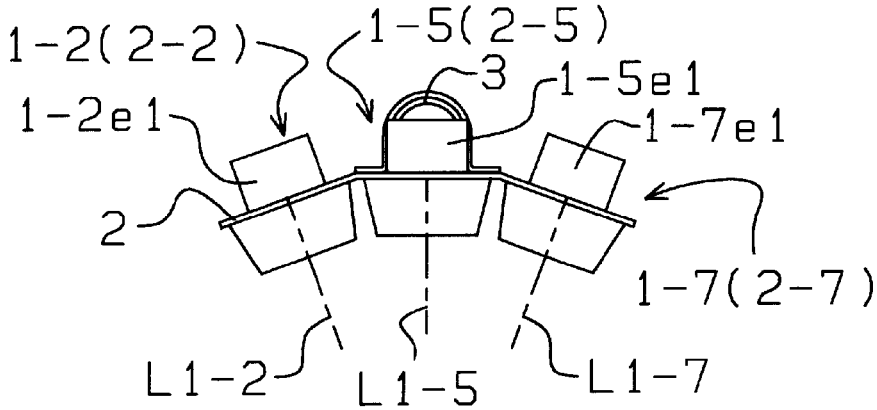
Figure 7:
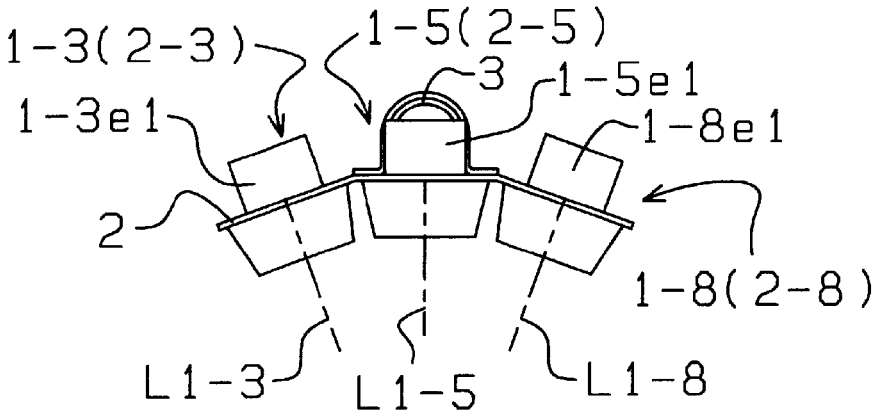

FIG. 5 to FIG. 7 illustrate the state where eight light emitting device modules 1 (1-1, 1-2, 1-3, 1-4, 1-5, 1-6, 1-7, and 1-8) shown in FIG. 1 are mounted on the installation member 2 as shown in FIG. 3 and FIG. 4.

In particular, FIG. 5(A) is a plan view of the installation member 2 on which the light emitting device modules 1 (1-1, 1-2, 1-3, 1-4, 1-5, 1-6, 1-7, and 1-8) are mounted and a part of the support 3, and FIG. 5(B) is a front view of the installation member 2 on which the light emitting device modules 1 (1-1, 1-2, 1-3, 1-4, 1-5, 1-6, 1-7, and 1-8) are mounted and a part of the support 3. FIG. 6(A) is a left side view of the installation member 2 on which the light emitting device modules 1 (1-1, 1-2, 1-3, 1-4, 1-5, 1-6, 1-7, and 1-8) are mounted and a part of the support 3, and FIG. 6(B) is a bottom view of the installation member 2 on which the light emitting device modules 1 (1-1, 1-2, 1-3, 1-4, 1-5, 1-6, 1-7, and 1-8) are mounted and a part of the support 3.

FIG. 7(A) is a similar illustration as compared to FIG. 5(B), which illustrates the positional relationship among the light emitting device modules 1-2, 1-4, and 1-7, which are mounted on the installation member 2. FIG. 7(B) is also a similar illustration as compared to FIG. 5(B), which illustrates the positional relationship among the light emitting device modules 1-2, 1-5, and 1-7, mounted on the installation member 2. FIG. 7(C) is also a similar illustration as compared to FIG. 5(B), which illustrates the positional relationship among the light emitting device modules 1-3, 1-5, and 1-8, mounted on the installation member 2.

FIG. 8 is an overall view of the lighting fixture 10 according to the first embodiment. In particular, FIG. 8(A) is a front view of the lighting fixture 10 of the first embodiment, and FIG. 8(B) is a left side view of the lighting fixture 10 of the first embodiment.

In the lighting fixture 10 of the first embodiment, as shown in FIG. 5 to FIG. 7, the main optical axis lines L1-4 and L1-5 of the light emitting device modules 1-4 and 1-5 can be positioned at the center and directed towards the lower side. The main optical axis lines L1-1, L1-2, and L1-3 of the light emitting device modules 1-1, 1-2, and 1-3 can be positioned at the left side in the figure and pointed to the lower-right direction, and those of the light emitting device modules 1-6, 1-7, and 1-8 can be positioned at the right side in the figure and pointed to the lower-left direction.

The main optical axis lines of the light emitting device modules arranged on the left and right sides are in skewed position with respect to the main optical axis lines L1-4 and L1-5 of the light emitting device modules 1-4 and 1-5 placed at the center, being displaced from one another in the longitudinal direction. For example, the main optical axis line L1-4 of the light emitting device module 1-4 is in a skewed position with respect to the main axis lines L1-1, L1-2, L1-6, and L1-7 of the light emitting device modules 1-1, 1-2, 1-6, and 1-7. Similarly, the main optical axis line L1-5 of the light emitting device module 1-5 is in a skewed position with respect to the main axis lines L1-2, L1-3, L1-7, and L1-8 of the light emitting device modules 1-2, 1-3, 1-7, and 1-8.

In addition, the light emitting device modules at the positions opposed to each other on both sides can be arranged in such a manner that the main optical axis line of one side and the main optical axis line of the other form a certain angle larger than zero degrees. Specifically, the angle between the main optical axis line L1-1 of the light emitting device module 1-1 and the main optical axis line L1-6 of the light emitting device module 1-6, the angle between the main optical axis line L1-2 of the light emitting device module 1-2 and the main optical axis line L1-7 of the light emitting device module 1-7, and the angle between the main optical axis line L1-3 of the light emitting device module 1-3 and the main optical axis line L1-8 of the light emitting device module 1-8, are larger than zero degrees, respectively.

According to the arrangement as described above, the eight light emitting device modules 1-1, 1-2, 1-3, 1-4, 1-5, 1-6, 1-7, and 1-8 are allowed to illuminate different areas or emit in different directions.

Furthermore, in the lighting fixture 10 of the first embodiment, all the fins 1-1*e*1 to 1-8*e*1 are parallel with respect to the vertical plane, and those fins are arranged in such a manner that the roots of the fins are positioned lower than the tips thereof.

Here, the light emitting device module 1-1 is taken as an example for explanation. As shown in FIG. 5(A), FIG. 5(B), and FIG. 6(A), all the fins 1-1*e*1 are arranged so that those fins are made parallel with respect to the vertical plane, and the roots of the fins 1-1*e*1 (the lower-right part of FIG. 5(B)) are positioned lower than the tips of the fins 1-2*e*1 (the upper-left part of FIG. 5(B)).

Therefore, the air that receives the heat from the fin 1-1*e*1 of the light emitting device module 1-1 is allowed to rise directly above along the surface of the fin 1-1*e*1. Consequently, the radiation by the fin 1-1*e*1 can be effectively enhanced.

The situation above is similarly applicable to all the fins 1-1*e*1 to 1-8*e*1 of all the light emitting device modules 1-1 to 1-8. Accordingly, while preventing deterioration of radiation efficiency by the fins 1-1*e*1, 1-2*e*1, 1-3*e*1, 1-4*e*1, 1-5*e*1, 1-6*e*1, 1-7*e*1, and 1-8*e*1, the eight light emitting device modules 1-1, 1-2, 1-3, 1-4, 1-5, 1-6, 1-7, and 1-8 are allowed to illuminate different directions.

Further, in the lighting fixture 10 of the first embodiment, the area illuminated by one light emitting device module 1 does not coincide exactly or approximately with the area illuminated by the overall lighting fixture. Rather, the area illuminated by one light emitting device module 1 is smaller than the area illuminated by the overall lighting fixture.

In particular, an illumination area of the overall lighting fixture is divided into multiple small areas, and the illumination area of one light emitting device module 1 is allocated one of the small areas. There can be provided an overlapping part between the illumination areas of adjacent light emitting device modules.

Figure 9:
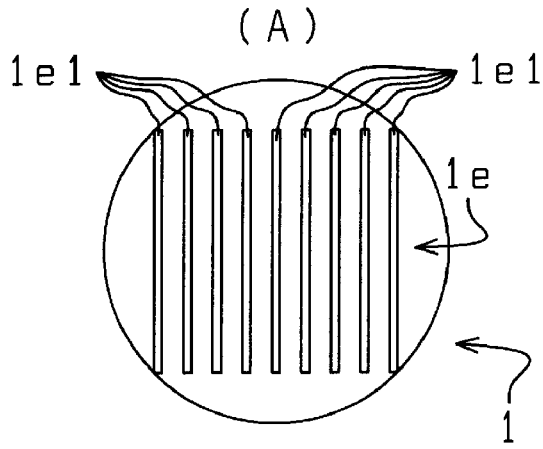
FIGS. 9(A)-(D) illustrate a light emitting device module constituting a part of a lighting fixture according to a second embodiment.
Figure 9:
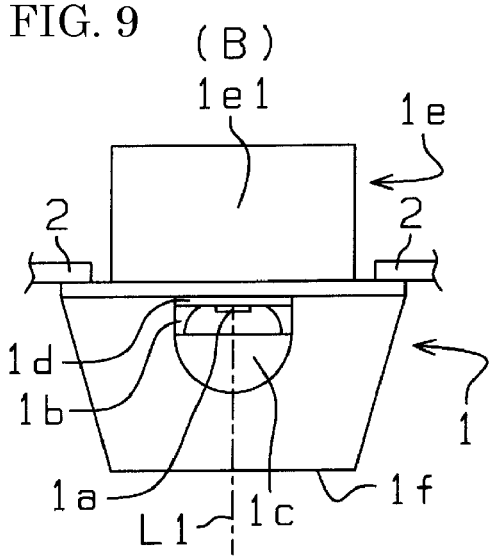
Figure 9:
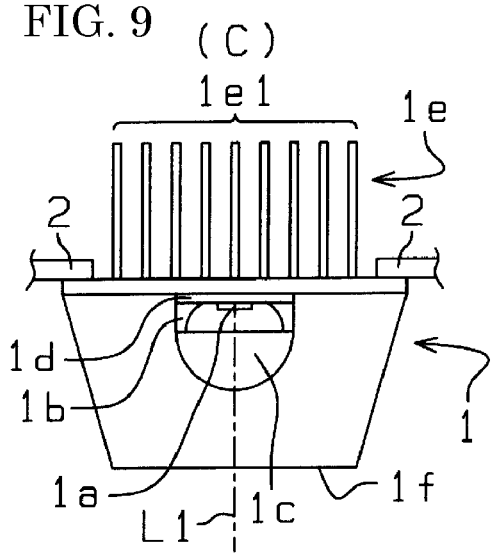
Figure 9:
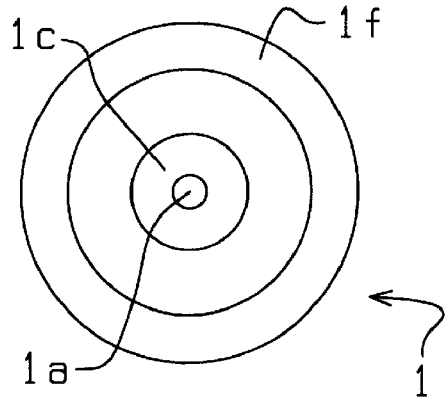

Next, with reference to FIG. 9 and FIG. 10, the lighting fixture of a second embodiment will be explained. The lighting fixture of the second embodiment is different from the first embodiment in that a light emitting device module 1 as shown in FIG. 9 is employed instead of the light emitting device module 1 shown in FIG. 1. Except for this point, the lighting fixture of the second embodiment can be almost the same as the lighting fixture 10 of the aforementioned first embodiment, resulting in an approximately similar effect.

FIG. 9 illustrates the light emitting device module 1 constituting a part of the lighting fixture according to the second embodiment. In particular, FIG. 9(A) is a plan view of the light emitting device module 1 of the lighting fixture of the second embodiment, FIG. 9(B) is a left side view of the light emitting device module 1 of the lighting fixture of the second embodiment, partially illustrated in section, FIG. 9(C) is a front view of the light emitting device module 1 of the lighting fixture of the second embodiment, partially illustrated in section, and FIG. 9(D) is a bottom view of the light emitting device module 1 of the lighting fixture of the second embodiment.

Figure 10:
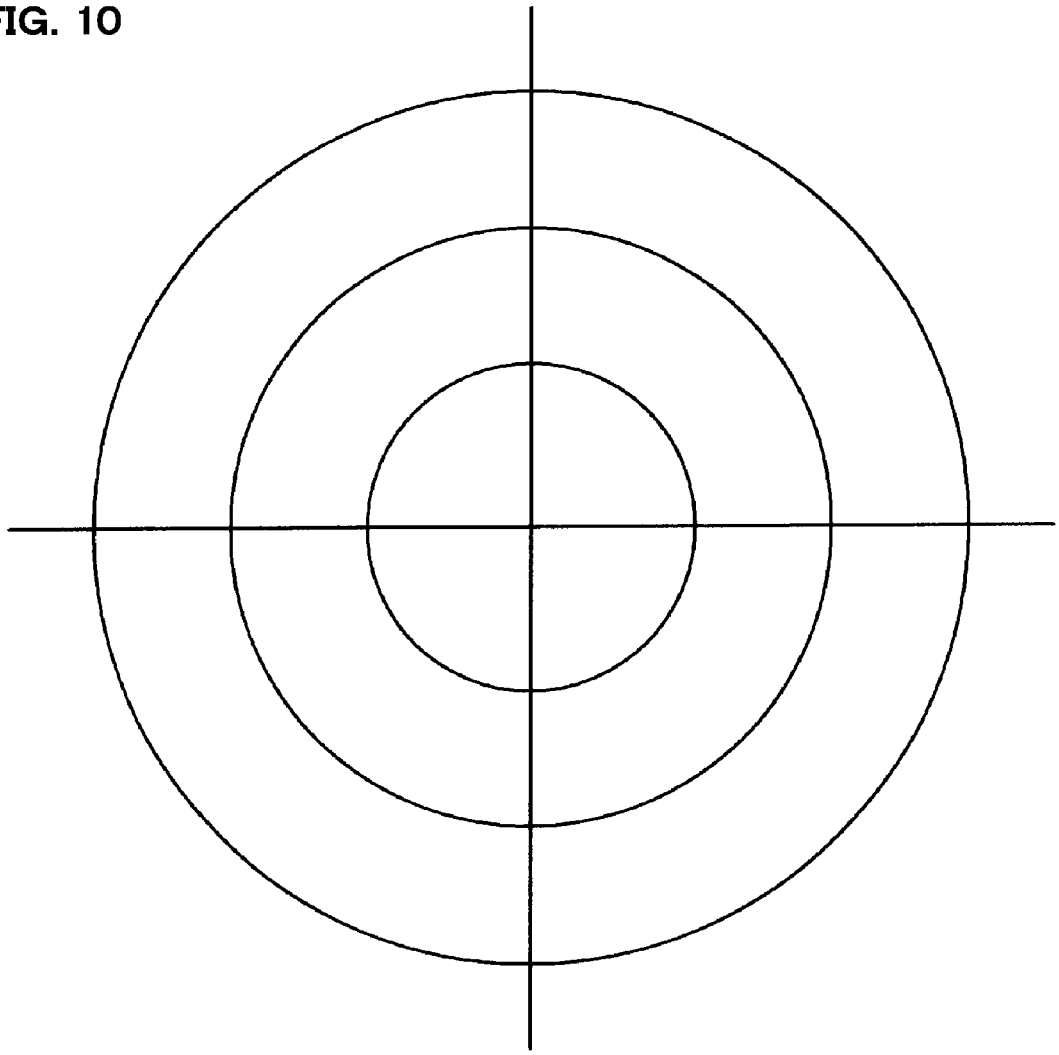
FIG. 10 illustrates a light distribution pattern emitted from the light emitting device of the lighting fixture according to the second embodiment.

FIG. 10 illustrates a light distribution pattern of the light emitted from the light emitting device module 1 of the lighting fixture according to the second embodiment as shown in FIG. 9.

In the lighting fixture 10 of the first embodiment, three light emitting devices 1*a* are provided on the light emitting device module 1 as shown in FIG. 1. As shown in FIG. 2, the light distribution pattern emitted from the light emitting device module 1 is configured in such a manner such that it is more elongated in the lateral direction (upper-lower direction in FIG. 2), than the longitudinal direction (the left-right direction in FIG. 2). In the lighting fixture of the second embodiment, instead, as shown in FIG. 9, one light emitting device 1*a* having an approximately circular shape is provided on the light emitting device module 1, and as shown in FIG. 10, the light distribution pattern of the light emitted from the light emitting device module 1 is configured to form an approximately circular shape having a center located at the main optical axis line L1 (see FIG. 9(B) and FIG. 9(C)).

In particular, in the lighting fixture of the second embodiment, the light distribution pattern of the light emitting device module 1 is formed in an approximately circular shape having a center located at the main optical axis line L1 of the light emitting device module 1, so that a position where the light from the light emitting device module reaches is not changed, even when the light emitting device module is turned around (rotated) with respect to the installation member 2 (see FIG. 3 and FIG. 4).

In the lighting fixture of the second embodiment, similar to the lighting fixture 10 of the first embodiment, as shown in FIG. 5(B), FIG. 7(A), and FIG. 7(C), the main optical axis lines L1-1, L1-2, and L1-3 of the light emitting devices modules 1-1, 1-2, and 1-3 respectively mounted on the partitions 2-1, 2-2, and 2-3 of the installation member 2 are pointed to the lower right direction, and the main optical axis lines L1-6, L1-7, and L1-8 of the light emitting devices modules 1-6, 1-7, and 1-8 respectively mounted on the partitions 2-6, 2-7, and 2-8 of the installation member 2 are pointed to the lower left direction. Alternatively, as a third embodiment, the main optical axis lines L1-1, L1-2, and L1-3 of the light emitting devices modules 1-1, 1-2, and 1-3 respectively mounted on the partitions 2-1, 2-2, and 2-3 of the installation member 2 may be pointed to the lower right direction and also pointed to the front, and the main optical axis lines L1-6, L1-7, and L1-8 of the light emitting devices modules 1-6, 1-7, and 1-8 respectively mounted on the partitions 2-6, 2-7, and 2-8 of the installation member 2 may be pointed to the lower left direction and also pointed to the front.

In the lighting fixture of a third embodiment, when the light emitting device module 1 (see FIG. 9) is turned around to be mounted on the installation member 2 (see FIG. 3 and FIG. 4), the air that receives the heat from the fins 1*e*1 of all the light emitting device module 1 is allowed to rise directly above along the surface of the fins 1*e*1, similar to the lighting fixture of the first and the second embodiments. In particular, in the lighting fixture of the third embodiment, when the light emitting device module 1 (see FIG. 9) is turned around to be mounted on the installation member 2 (see FIG. 3 and FIG. 4), all the fins 1*e*1 become in parallel with respect to the vertical plane, and can be arranged in such a manner that the roots of the fins 1*e*1 are positioned lower than the tips of the fins 1*e*1. Consequently, the lighting fixture of the third embodiment is able to enhance the heat radiation by the fins 1*e*1 most effectively, similar to the lighting fixture of the first and second embodiment.

Next, with reference to FIG. 11, the lighting fixture of a fourth embodiment will be explained. The lighting fixture of the fourth embodiment has almost the same configuration and produces almost the same effect as the aforementioned lighting fixture 10 of the first embodiment, except in that a light emitting device module 1 as shown in FIG. 11 is employed.

Figure 11:
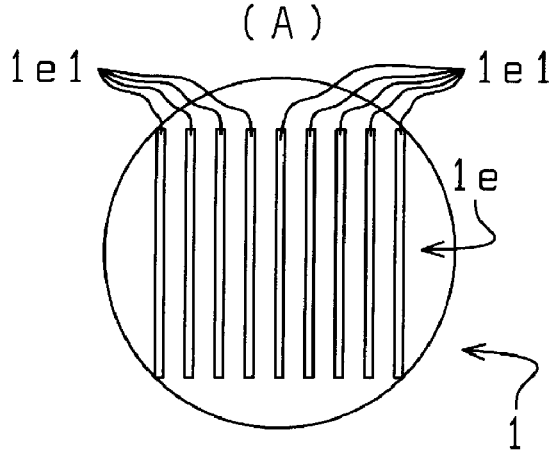
FIGS. 11(A)-(D) illustrate a light emitting device module constituting a part of a lighting fixture according to a fourth embodiment.
Figure 11:
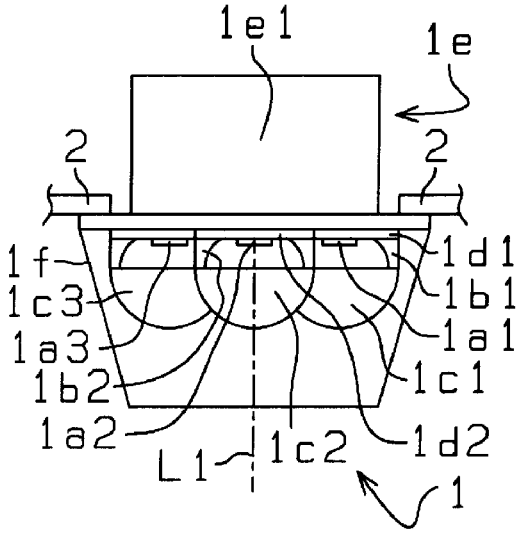
Figure 11:
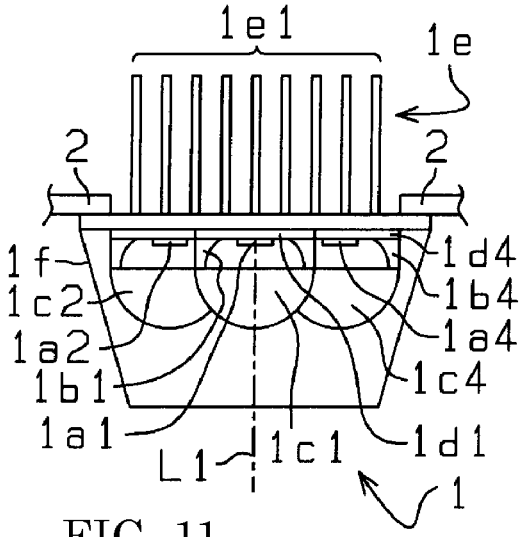
Figure 11:
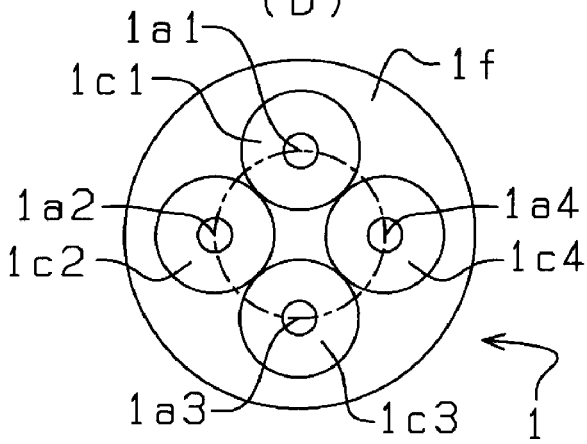

FIG. 11 illustrates the light emitting device module 1 constituting a part of the lighting fixture of the fourth embodiment. In particular, FIG. 11(A) is a plan view of the light emitting device module 1 of the lighting fixture of the fourth embodiment, FIG. 11(B) is a left side view of the light emitting device module 1 of the lighting fixture of the fourth embodiment, partially illustrated in section, FIG. 11(C) is a front view of the light emitting device module 1 of the lighting fixture of the fourth embodiment, partially illustrated in section, and FIG. 11(D) is a bottom view of the light emitting device module 1 of the lighting fixture of the fourth embodiment.

In the fourth embodiment, as shown in FIG. 11, there are arranged four light emitting devices 1*a*1, 1*a*2, 1*a*3, and 1*a*4 on the circle (an alternate long and short dash line of FIG. 11(D)) having a center located at the main optical axis line L1 of the light emitting device module 1. Then, as shown in FIG. 10, the light distribution pattern emitted from the light emitting device module 1 is configured in such a manner as forming an approximately circular shape having a center located at the main optical axis line L1 of the light emitting device module 1 (see FIG. 11(B) and FIG. 11(C)).

In particular, in the lighting fixture 10 of the first embodiment, as shown in FIG. 1, three sets made up of the light emitting device 1*a*, the reflector 1*b*, the lens 1*c*, and the thermal interface material 1*d* are linearly arranged. On the other hand, in the lighting fixture of the fourth embodiment, as shown in FIG. 11, a set made up of the light emitting device 1*a*1, the reflector 1*b*1, the lens 1*c*1, and the thermal interface material 1*d*1, a set made up of the light emitting device 1*a*2, the reflector 1*b*2, the lens 1*c*2, and the thermal interface 1*d*2, a set made up of the light emitting device 1*a*3, the reflector 1*b*3, the lens 1*c*3, and the thermal interface material 1*d*3, and a set made up of the light emitting device 1*a*4, the reflector 1*b*4, the lens 1*c*4, and the thermal interface material 1*d*4 are arranged on the circle.

In particular, the light-distribution pattern of the light emitting device module is formed in an approximately circular shape having a center located at the main optical axis line L1 of the light emitting device module, so that a position at which the light emitted from the light emitting device module 1 reaches is not changed, even when the light emitting device module 1 is turned around on the installation member 2 (see FIG. 3 and FIG. 4).

In the lighting fixture of the fourth embodiment, similar to the lighting fixture 10 of the first embodiment, as shown in FIG. 5(B), FIG. 7(A), and FIG. 7(C), the main optical axis lines L1-1, L1-2, and L1-3 of the light emitting device modules 1-1, 1-2, and 1-3 respectively mounted on the partitions 2-1, 2-2, and 2-3 of the installation member 2, are pointed to the lower right direction, and the main optical axis lines L1-6, L1-7, and L1-8 of the light emitting device modules 1-6, 1-7, and 1-8 respectively mounted on the partitions 2-6, 2-7, and 2-8 of the installation member 2 are pointed to the lower left direction.

Alternatively, in the lighting fixture of a fifth embodiment, the main optical axis lines L1-1, L1-2, and L1-3 of the light emitting device modules 1-1, 1-2, and 1-3 respectively mounted on the partitions 2-1, 2-2, and 2-3 of the installation member 2, may be pointed to the lower right direction and also pointed to the front, and the main optical axis lines L1-6, L1-7, and L1-8 of the light emitting device modules 1-6, 1-7, and 1-8 respectively mounted on the partitions 2-6, 2-7, and 2-8 of the installation member 2 may be pointed to the lower left direction and also pointed to the front.

In the lighting fixture of the fifth embodiment, when the light emitting device module 1 (see FIG. 11) is turned around to be mounted, the air that receives the heat from all the fins 1*e*1 of the light emitting device module 1 is allowed to rise directly above along the surface of each fin 1*e*1, similar to the lighting fixture of the first embodiment and that of the fourth embodiment. In particular, in the lighting fixture of the fifth embodiment, when the light emitting device module 1 (see FIG. 11) is turned around to be mounted on the installation member 2 (see FIG. 3 and FIG. 4), all the fins 1*e*1 become parallel with respect to the vertical plane, and all the fins 1*e*1 can be arranged in such a manner that the roots of the fins 1*e*1 are positioned lower than the tips of the fins 1*e*1. Consequently, also according to the lighting fixture of the fifth embodiment, the radiation by the fins 1*e*1 can be efficiently enhanced.

In the lighting fixture of the fourth embodiment, as shown in FIG. 11, four light emitting devices 1*a*1, 1*a*2, 1*a*3, and 1*a*4 are arranged on the circle having the main optical axis line L1 of the light emitting device module 1 as the center thereof. Alternatively, as a sixth embodiment, an arbitrary number of light emitting devices, at least two, are arranged on the circle having a center located at the main optical axis line L1 of the light emitting device, and the light distribution pattern emitted from the light emitting device module 1 may form an approximately circular shape having a center located at the main optical axis line L1 of the light emitting device module 1.

In addition, in the lighting fixture 10 of the first embodiment, as shown in FIG. 3 and FIG. 4, the installation member 2 is directly mounted on the support 3. Alternatively, as a seventh embodiment, the installation member 2 may be indirectly mounted on the support 3.

Next, as the eighth to twenty-seventh embodiments, there will be explained examples in which the cooling efficiency and heat transfer property are improved in a configuration other than the arrangement of the fins of the light emitting device module. Firstly, with reference to FIG. 12 to FIG. 14, the eighth embodiment will be explained. This lighting fixture has almost the same configuration as the lighting fixture of the aforementioned first embodiment except with regard to some points described below.

In the lighting fixture of the eighth embodiment, similar to the lighting fixture of the first embodiment, a part of the heat generated by the light emitting device 1*a* is radiated from the thermal interface material (heat transfer member) 1*d*. In brief, in the lighting fixture of the eighth embodiment, similar to the lighting fixture of the first embodiment, the thermal interface material (heat transfer member) 1*d* has a heat radiating function, in addition to the heat transferring function.

Figure 12:
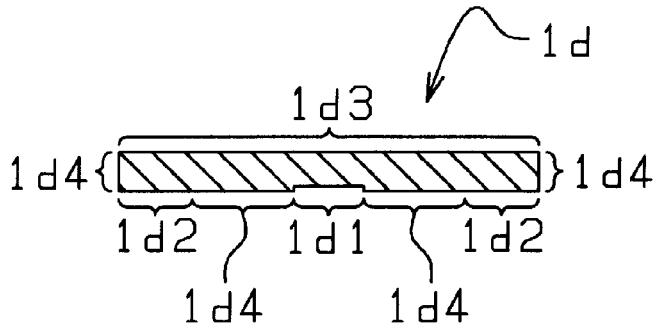
FIG. 12 is an enlarged sectional view of a thermal interface material (heat transfer member) of the lighting fixture according to an eighth embodiment.

FIG. 12 is an enlarged sectional view of the thermal interface material (heat transfer member) 1*d* (see FIG. 1) of the lighting fixture according to the eighth embodiment. In the lighting fixture of the first embodiment, a covering layer is not formed on a part exposed to the air, on the surface of the thermal interface material (heat transfer member) 1*d* having a function of heat radiation. In the lighting fixture of the eighth embodiment, as shown in FIG. 1 and FIG. 12, the covering layer is formed at the part 1*d*4 exposed to the air, on the surface of the thermal interface material (heat transfer member) 1*d* which has the function of heat radiation. Consequently, the efficiency for cooling the light emitting device 1*a* by the thermal interface material (heat transfer member) 1*d* is enhanced.

Instead of forming the covering layer at the part 1*d*4 exposed to the air of the thermal interface material (heat transfer member) 1*d*, the part 1*d*4 exposed to the air on the surface of the thermal interface material (heat transfer member) 1*d* may be subjected to a roughening process (the ninth embodiment).

In the lighting fixture of the eighth embodiment, as shown in FIG. 1 and FIG. 12, the covering layer is not formed at the part that is in contact with a thing other than the air, on the surface of the thermal interface material (heat transfer member) 1*d* which has the function of heat transfer. In particular, on the surface of the thermal interface material (heat transfer member) 1*d*, the covering layer is not formed, at the part 1*d*1 being in contact with the light emitting device, at the part 1*d*2 being in contact with the reflector 1*b*, and at the part 1*d*3 that is in contact with the housing 1*e*.

The part where the covering layer is not formed on the surface of the thermal interface material (heat transfer member) 1*d* having the heat transfer function, that is, the part 1*d*1 being in contact with the light emitting device 1*a*, the part 1*d*2 being in contact with the reflector 1*b*, the part 1*d*3 being in contact with the housing 1*e*, are all polished. Consequently, the heat transfer resistance is reduced between the thermal interface material (heat transfer member) 1*d*, and those elements; the light emitting device 1*a*, the reflector 1*b*, and the housing 1*e*.

It is to be noted that these parts 1*d*1, 1*d*2, and 1*d*3 may be left as untreated solid surfaces, instead of being polished (the tenth embodiment).

Figure 13:
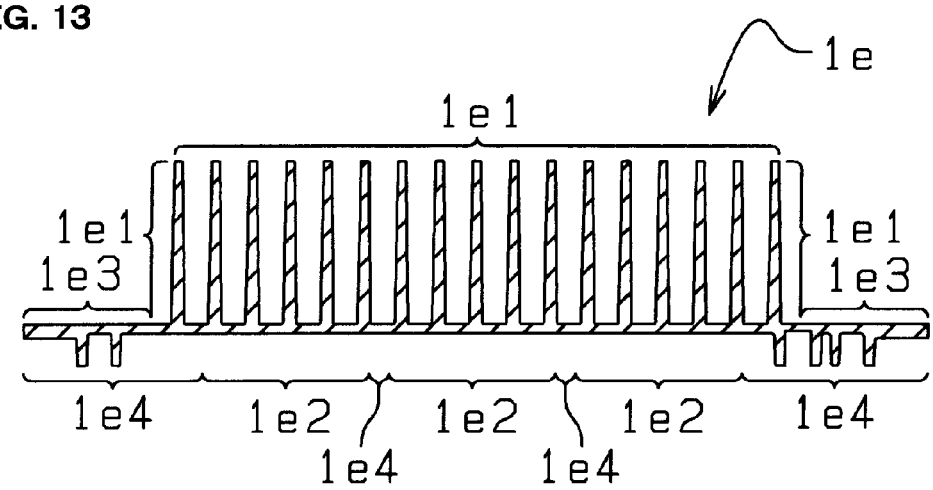
FIG. 13 is an enlarged sectional view of a housing of a lighting fixture according to the eighth embodiment.

FIG. 13 is an enlarged sectional view of the housing 1*e* (see FIG. 1) of the lighting fixture of the eighth embodiment. In the lighting fixture of the first embodiment, on the surface of the housing 1*e* having the heat radiation function, a covering layer is not formed at a part of the fin 1*e*1 exposed to the air, nor at a part exposed to the air other than the fin 1*e*1. Alternatively, in the lighting fixture of the eighth embodiment, as shown in FIG. 1 and FIG. 13, the covering layer is formed at the part of the fin 1*e*1 exposed to the air, and the part exposed to the air other than the fin 1*e*1, on the surface of the housing 1*e* having the heat radiation function. Consequently, efficiency for cooling the light emitting device 1*a* by the housing 1*e* is enhanced.

It is to be noted that instead of forming the covering layer at the part of the fin 1*e*1 exposed to the air, and the part 1*e*4 exposed to the air other than the fin 1*e*1 on the surface of the housing 1*e*, those parts may be subjected to the roughening process (the eleventh embodiment).

In the lighting fixture of the eighth embodiment, as shown in FIG. 1 and FIG. 13, the covering layer is not formed at the part in contact with the thing other than the air, on the surface of the housing 1*e* having the heat transfer function. In particular, on the surface of the housing 1*e*, the covering layers are not formed at the part 1*e*2 in contact with the thermal interface material (heat transfer member) 1*d*, and at the part 1*e*3 in contact with the installation member 2. The parts on which the covering layer is not formed can be polished. Consequently, the heat transfer resistance is reduced between the housing 1*e* and the following elements; the heat transfer member 1*d* and the installation member 2.

It is to be noted that, on the surface of the housing 1*e*, the part 1*e*2 in contact with the thermal interface material (heat transfer member) 1*d*, and the part 1*e*3 in contact with the installation member 2 may be left as solid surfaces, instead of being polished (the twelfth embodiment).

Figure 14:
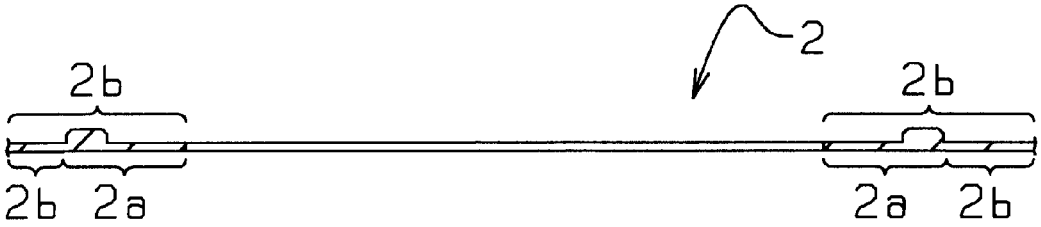
FIG. 14 is an enlarged sectional view of a part of the installation member of the lighting fixture according to the eighth embodiment.

FIG. 14 is a sectional view of a part of the installation member 2 (see FIG. 1) of the lighting fixture of the eighth embodiment. In the lighting fixture of the first embodiment, a covering layer is not formed at the part exposed to the air on the surface of the installation member 2 having the heat radiation function. In the lighting fixture of the eighth embodiment, as shown in FIG. 1 and FIG. 14, the covering layer is formed at the part 2*b* exposed to the air on the surface of the installation member 2 having the heat radiation function. Consequently, the efficiency for cooling the light emitting device 1*a* by the installation member 2 is enhanced.

The part 2*b* exposed to the air on the surface of the installation member 2 may be subjected to the roughening process, instead of forming the covering layer thereon (the thirteenth embodiment).

In the lighting fixture of the eighth embodiment, as shown in FIG. 1 and FIG. 14, a covering layer is not formed on a part in contact with the thing other than the air, on the surface of the installation member 2 having the heat transfer function. In particular, the covering layer is not formed at the part 2*a* which is in contact with the housing 1*e*, on the surface of the installation member 2. This part can be polished. Consequently, the heat transfer resistance between the installation member 2 and the housing 1*e* is reduced.

It is to be noted that the part 2*a* which is in contact with the housing 1*e*, on the surface of the installation member 2, may be left as a solid surface, instead of being polished (the fourteenth embodiment).

In the lighting fixture of the eighth embodiment, a grease-like or a sheet-like thermally conductive interface material (not illustrated) may be placed between members that are directly in contact. For example, in the lighting fixture of the eighth embodiment, as shown in FIG. 1 and FIG. 12, the light emitting device 1*a* directly contacts the part 1*d*1 on the surface of the thermal interface material (heat transfer member) 1*d*, and the above thermally conductive interface material may be placed therebetween (the fifteenth embodiment).

In the lighting fixture of the eighth embodiment, the thermal interface material (heat transfer member) 1*d* comes into contact with the reflector 1*b* directly at the part 1*d*2, and the thermally conductive interface material may be placed therebetween (the sixteenth embodiment).

In the lighting fixture of the eighth embodiment, as shown in FIG. 1, FIG. 12, and FIG. 13, the part 1*d*3 in contact with the housing 1*e* on the surface of the thermal interface material (heat transfer member) 1*d*, directly contacts the part 1*e*2 that comes into contact with the heat transfer member 1*d* on the surface of the housing 1*e*. The thermally conductive interface material may be placed therebetween (the seventeenth embodiment).

In the lighting fixture of the eighth embodiment, as shown in FIG. 1, FIG. 13, and FIG. 14, the part 1*e*3 in contact with the installation member 2 on the surface of the housing 1*e*, directly contacts the part 2*a* that comes into contact with the housing 1*e* on the surface of the installation member 2. The thermally conductive interface material may be placed therebetween (the eighteenth embodiment).

In the lighting fixture of the eighth embodiment, as shown in FIG. 1, three sets of the light emitting device 1*a*, the reflector 1*b*, and the lens 1*c* are provided on one light emitting device module 1. Alternatively, an arbitrary number of sets of the light emitting device 1*a*, the reflector 1*b*, and the lens 1*c*, other than three, may be provided on one light emitting device module 1 (the nineteenth embodiment).

In the lighting fixture of the eighth embodiment, as shown in FIG. 3 and FIG. 4, a covering layer is not formed on a part which is in contact with a lampshade (not illustrated) on the surface of the installation member 2 which has a heat transferring function. This part can be polished, for example. Consequently, the heat transfer resistance between the installation member 2 and the lampshade is reduced.

It is to be noted that the part in contact with the lampshade on the surface of the installation member 2 may be left as a solid surface, instead of being polished (the twentieth embodiment).

In addition, in the lighting fixture of the eighth embodiment, the covering layer is formed at the part exposed to the air on the surface of the lampshade (not illustrated) having the heat radiation function. Consequently, efficiency for cooling the light emitting device 1 by the lampshade (not illustrated) is enhanced.

It is to be noted that instead of forming the covering layer at the part exposed to the air on the surface of the lampshade, a roughening process may be performed thereon (the twenty-first embodiment).

In the lighting fixture of the eighth embodiment, the covering layer is not formed at the part contacting a thing other than the air on the surface of the lampshade having the heat transferring function, specifically, the part contacting the installation member 2. This part can be polished. Consequently, the heat transfer resistance between the lampshade and the installation member 2 is reduced.

It is to be noted that the part of the lampshade, contacting the installation member 2, may be left as a solid surface, instead of being polished (the twenty-second embodiment).

In the lighting fixture of the eighth embodiment, the part contacting the lampshade (not illustrated), on the surface of the installation member 2, directly contacts the part that is in contact with the installation member 2 on the surface of the lampshade. Alternatively, a grease-like or a sheet-like thermally conductive interface material (not illustrated) may be placed therebetween (the twenty-third embodiment).

In the lighting fixture of the eighth embodiment, as shown in FIG. 8, on the surface of the installation member 2, a covering layer is not formed on the part that is in contact with the support 3. This part can be polished, if desired. Consequently, the heat transfer resistance between the installation member 2 and the support 3 can be reduced.

It is to be noted that the part of the installation member 2, which is in contact with the support 3, may be left as a solid surface, instead of being polished (the twenty-fourth embodiment).

Furthermore, in the lighting fixture of the first embodiment, as shown in FIG. 8, the covering layer is not formed at the part exposed to the air on the surface of the support 3 having the heat radiation function. However, in the lighting fixture of the eighth embodiment, the covering layer is formed at the part exposed to the air on the surface of the support 3 having the heat radiation function. Consequently, the efficiency for cooling the light emitting device 1*a* by the support 3 is enhanced. On the surface of the support 3, the part exposed to the air may be subjected to the roughening process, instead of forming the covering layer thereon (the twenty-fifth embodiment).

In the lighting fixture of the eighth embodiment, as shown in FIG. 8, the surface of the support 3 having the heat transfer function may not include the covering layer formed thereon at the part in contact with the thing other than the air, specifically, at the part in contact with the installation member 2.

This part can be polished. Consequently, the heat transfer resistance between the support 3 and the installation member 2 can be reduced.

On the surface of the support 3, the part contacting the installation member 2 may be left as a solid surface instead of being polished (the twenty-sixth embodiment).

In the lighting fixture of the eighth embodiment as shown in FIG. 8, on the surface of the installation member 2, the part in contact with the support 3, directly contacts the part that is in contact with the installation member 2 on the surface of the support 3. Alternatively, a grease-like or a sheet-like thermally conductive interface material (not illustrated) may be placed therebetween (the twenty-seventh embodiment).

Figure 15:
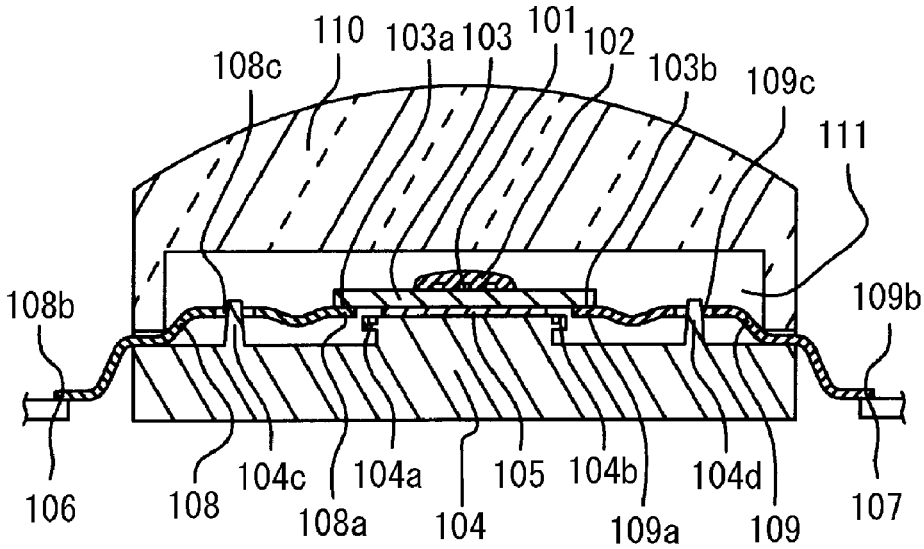
FIG. 15 is a sectional view of a portion of a light emitting device module of a lighting fixture according to a twenty-eighth embodiment.
Figure 16:
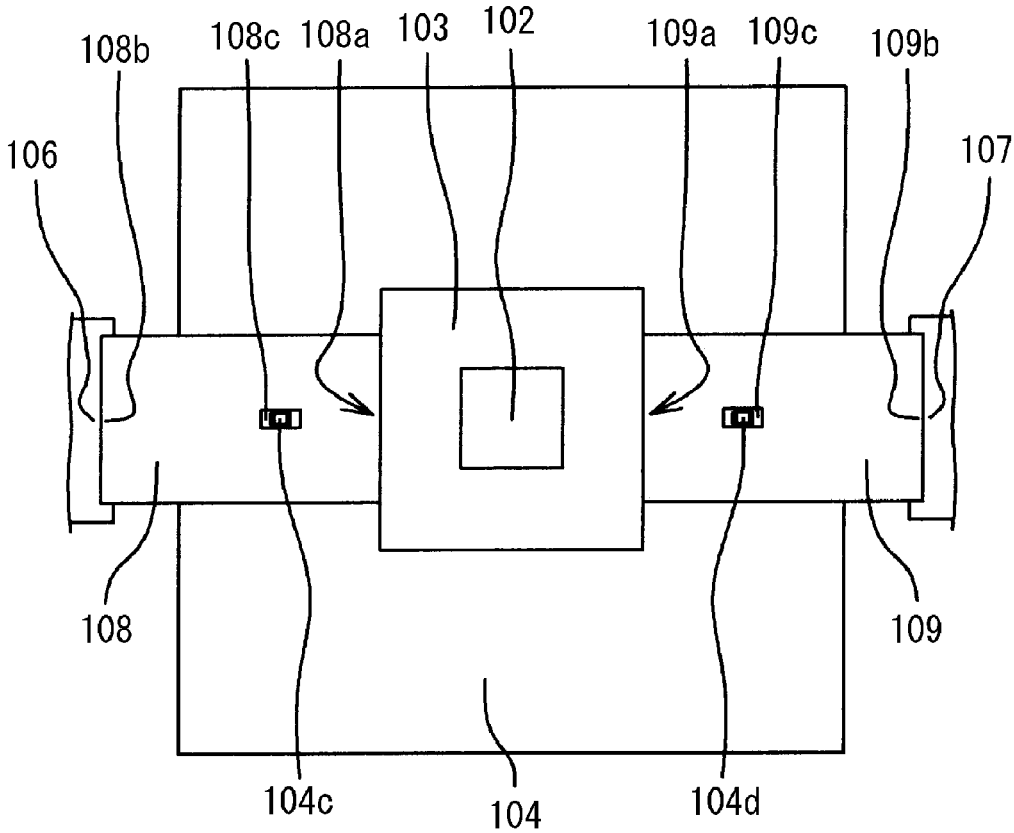
FIG. 16 is a plan view of a portion of the light emitting device module of the lighting fixture according to the twenty-eighth embodiment, in the state where the lens is removed.

Next, the lighting fixture of the twenty-eighth embodiment will be explained with reference to FIG. 15 to FIG. 17. FIG. 15 is a sectional view of a portion of the light emitting device module of the lighting fixture according to the twenty-eighth embodiment. FIG. 16 is a plan view of the portion of the light emitting device module of the lighting fixture according to the twenty-eighth embodiment in the state where the lens 110 is removed. In particular, FIG. 16 is an illustration of the portion of the light emitting device module of the lighting fixture of the twenty-eighth embodiment, when viewing FIG. 15 from the top, in the state where the lens 110 is removed.

The lighting fixture of the twenty-eighth embodiment is configured to be approximately the same as the lighting fixture 10 of the aforementioned first embodiment, except with regard to some points described below. Therefore, it is possible to produce approximately the same effect as achieved with the lighting fixture 10 of the aforementioned first embodiment.

In the lighting fixture of the first embodiment, as shown in FIG. 1, a portion of the light emitting device module 1 is made up of the light emitting device 1*a*, the reflector 1*b*, the lens 1*c*, and the thermal interface material 1*d*. Alternatively, in the lighting fixture of the twenty-eighth embodiment, the portion of the light emitting device module is configured as shown in FIG. 15 and FIG. 16.

In FIG. 15 and FIG. 16, the reference numeral 101 indicates a light emitting device like an LED chip, for example, and the reference numeral 102 indicates a fluorescence substance applied on or adjacent the light emitting device 101. The reference numeral 103 indicates a base for supporting the light emitting device 101 and the fluorescence substance 102. The reference numerals 103*a* and 103*b* indicate light-emitting device feeding electrodes formed on the lower surface of the base 103, for feeding the light emitting device 101, which is placed on the base 103. In the lighting fixture of the twenty-eighth embodiment, the light emitting device 101, the fluorescence substance 102, and the base 103 constitute a package such as an LED package, for example. The light emitting device feeding electrode 103*a* is electrically connected to an anode electrode (not illustrated), and the light emitting device feeding electrode 103*b* is electrically connected to a cathode electrode (not illustrated) of the light emitting device 101. The base 103 is made of a material having a relatively high thermal conductivity.

In FIG. 15 and FIG. 16, the reference numeral 104 indicates a substrate for supporting the base 103, the reference numeral 105 indicates an adhesive agent for fixing the base 103 onto the substrate 104. The substrate 104 can be made of a material having a relatively high thermal conductivity, such as Al and ADC (Aluminum Die-Cast), and the adhesive agent can be made of a material having a relatively high thermal conductivity.

In FIG. 15 and FIG. 16, the reference numerals 106 and 107 indicate external electrodes for feeding the light emitting device 101. The external electrodes 106 and 107 are configured in such a manner as to be movable with respect to the light emitting device 101. Alternatively, these electrodes are placed at positions relatively distant from the light emitting device 101 to such an extent that the temperature of the external electrodes 106 and 107 is not raised even when that light emitting device 101 generates heat.

In FIG. 15 and FIG. 16, the reference numeral 108 indicates a flexible substrate as a connecting member for connecting the light emitting device feeding electrode 103*a* and the external electrode 106. The reference numerals 108*a* and 108*b* indicate terminals formed on the flexible substrate 108. The reference numeral 108*c* indicates an elongate hole for guiding via the terminal 108*a*, the flexible substrate 108 for connection to the light emitting device feeding electrode 103*a* of the base 103 toward the external electrode 106 side. The reference numeral 104*c* indicates a protrusion placed on the upper surface of the substrate 104, for slidably fitting into the elongate hole 108*c*. The flexible substrate 108 is connected to the external electrode 106 via the terminal 108*b*.

In the lighting fixture of the twenty-eighth embodiment, the terminal 108*a* of the flexible substrate 108 is connected to the light emitting device feeding electrode 103*a* by soldering (not illustrated), and the terminal 108*b* of the flexible substrate 108 is connected to the external electrode 106 by soldering (not illustrated). Alternatively, the terminal 108*a* of the flexible substrate 108 may be connected to the light emitting device feeding electrode 103*a* via a connector (not illustrated), and the terminal 108*b* of the flexible substrate 108 may be connected to the external electrode 106 via a connector (not illustrated) (the twenty-ninth embodiment).

Furthermore, in FIG. 15 and FIG. 16, the reference numeral 109 indicates a flexible substrate as a connecting member for connecting the light emitting device feeding electrode 103*b* with the external electrode 107. The reference numeral 109*a* and 109*b* indicate the terminals formed on the flexible substrate 109, and the reference numeral 109*c* indicates an elongate hole for guiding, via the terminal 109*a*, the flexible substrate 109 for connection to the light emitting device feeding electrode 103*b* of the base 103 toward the external electrode 107 side. The reference numeral 104*d* indicates a protrusion placed on the upper surface of the substrate 104, for fitting into the elongate hole 109*c* slidably. The flexible substrate 109 is connected to the external electrode 107 via the terminal 109*b*.

In the lighting fixture of the twenty-eighth embodiment, the terminal 109*a* of the flexible substrate 109 is connected to the light emitting device feeding electrode 103*b* by soldering (not illustrated), and the terminal 109*b* of the flexible substrate 109 is connected to the external electrode 107 by soldering (not illustrate). Alternatively, the terminal 109*a* of the flexible substrate 109 may be connected to the light emitting device feeding electrode 103*b* via a connector (not illustrated), and the terminal 109*b* of the flexible substrate 109 may be connected to the external electrode 107 via a connector (not illustrated) (the thirtieth embodiment).

In FIG. 15 and FIG. 16, the reference numeral 111 indicates a space between the upper surface of the fluorescence substance 102, the base 103, and the substrate 104, and the lower surface of the lens 110. The reference numeral 104*a* indicates a gutter, serving as an anti-running means for preventing the adhesive agent 105 from flowing out from between the base 103 and the substrate 104 toward the side of the external electrode 106 (the left side of FIG. 15). The reference numeral 104*b* indicates a gutter, serving as an anti-running means for preventing the adhesive agent 105 from flowing out from between the base 103 and the substrate 104 toward the side of the external electrode 107 (the right side of FIG. 15).

Figure 17:
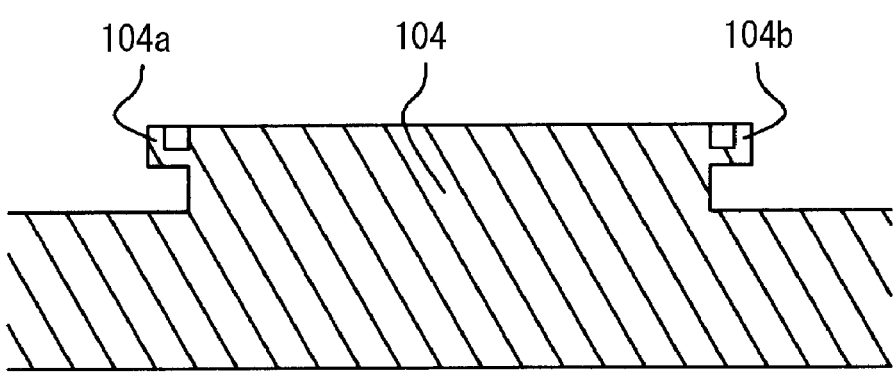
FIG. 17 is an enlarged view of the gutters shown in FIG. 15.

FIG. 17 is an enlarged illustration of the gutters 104*a* and 104*b* shown in FIG. 15. In the lighting fixture of the twenty-eighth embodiment, as shown in FIG. 15 and FIG. 17, the gutter 104*a* is provided so that even if the adhesive agent 105 flows out from between the base 103 and the substrate 104 toward the side of the external electrode 106 (the left side of FIG. 15 and FIG. 17), the adhesive agent 105 that flows out is stopped by the gutter 104*a* and can be prevented from reaching the light emitting device feeding electrode 103*a* and the terminal 108*a*. Similarly, the gutter 104*b* is provided so that even if the adhesive agent 105 flows out from between the base 103 and the substrate 104 toward the side of the external electrode 107 (the right side of FIG. 15 and FIG. 17), the adhesive agent 105 that flows out can be stopped by the gutter 104*b* and prevented from reaching the light emitting device feeding electrode 103*b* and the terminal 109*a*.

Furthermore, in the lighting fixture of the twenty-eighth embodiment, as shown in FIG. 15 and FIG. 16, the flexible substrate 108 connecting the light emitting device feeding electrode 103*a* and the external electrode 106, and the flexible substrate 109 connecting the light emitting device feeding electrode 103*b* and the external electrode 107, are placed within the space 111, not sealed by resin. This configuration enables a reduction in thermal stress applied on the flexible substrates 108 and 109 more than in the case where the flexible substrates 108 and 109 are sealed by resin.

In the lighting fixture of the twenty-eighth embodiment, as described above, the external electrode 106 is configured to be movable with respect to the light emitting device 101, or, the electrode is placed at a position relatively distant from the light emitting device 101 to such an extent that the temperature of the external electrodes 106 is not raised even when that light emitting device 101 generates heat. In other words, the flexible substrate 108 is constrained so that out of the two terminals 108*a* and 108*b* of the flexible substrate 108, the terminal 108*a* connected to the light emitting device feeding electrode 103*a* serves as a fixed end, and the terminal 108*b* connected to the external electrode 106 serves as a free end. That is, the flexible substrate 108 is constrained in such a manner as substantially forming a cantilever structure.

Therefore, it is possible to reduce the thermal stress applied to the flexible substrate 108 to a greater degree than in the case where both the terminal 108*a* connected to the light emitting device feeding electrode 103*a* and the terminal 108*b* connected to the external electrode 106 are configured as fixed ends, i.e., when the flexible substrate 108 is constrained to substantially form a fixed beam structure. In particular, more than the case where the external electrode 106 is relatively fixed to the light emitting element device 101 and the external electrode 106 is placed relatively close to the light emitting device 101 to such an extent that the temperature of the external electrodes 106 is raised when that light emitting device 101 generates heat, the thermal stress applied to the flexible substrate 108 can be reduced.

In brief, the lighting fixture of the twenty-eighth embodiment is configured in such a manner that only the terminal 108*a* of the flexible substrate 108 is constrained, and the other part is not constrained. Therefore, even when the temperature of the flexible substrate 108 is raised along with the heat generation by the light emitting device 101, the flexible substrate 108 is allowed to freely thermally expand, without applying thermal stress to the flexible substrate 108. In other words, by reducing the thermal stress applied to the flexible substrate 108, the possibility of solder separation may be reduced, and thereby reliability can be enhanced.

In the lighting fixture of the twenty-eighth embodiment, the light emitting device feeding electrode 103*a* is connected to the external electrode 106 via the flexible substrate 108. Alternatively, the light emitting device feeding electrode 103*a* may be connected to the external electrode 106 by any connecting member, such as a wire and a glass epoxy substrate, for instance (the thirty-first embodiment).

In particular, in the lighting fixture of the thirty-first embodiment, similar to the lighting fixture of the twenty-eighth embodiment, the external electrode 106 is configured in such a manner as to be movable with respect to the light emitting device 101. Alternatively, the external electrode 106 can be arranged at a position relatively distant from the light emitting device 101 to such an extent that the temperature of the external electrodes 106 is not raised even when that light emitting device 101 generates heat. In other words, the connecting member is constrained in such a manner that one terminal connected to the light emitting device feeding electrode 103*a*, out of the two terminals of the connecting member, serves a fixed end, and another terminal connected to the external electrode 106 serves as a free end. That is, the connecting member is constrained in such a manner as to substantially form a cantilever structure. Therefore, also according to the lighting fixture of the thirty-first embodiment, an effect approximately the same as the effect of the twenty-eighth embodiment can be produced.

The flexible substrate 109 that connects the light emitting device 101 and the external electrode 107 can have exactly the same configuration as the flexible substrate 108, and the flexible substrate 109 is constrained in such a manner as to substantially form a cantilever structure. Therefore, even when the temperature of the flexible substrate 109 is raised during heat generation by the light emitting device 101, the flexible substrate 109 is allowed to freely thermally expand, without applying thermal stress thereto, and the possibility of solder separation may be reduced, thereby enhancing reliability of the device.

Instead of using the flexible substrate 109, the light emitting device feeding electrode 103*b* may be connected to the external electrode 107 by any connecting member, such as a wire and a glass epoxy substrate, for instance (the thirty-second embodiment), and the same effect can be obtained.

In the lighting fixture of the twenty-eighth embodiment, as shown in FIG. 15, the substrate 104 that is the heat radiation member for radiating the heat generated by the light emitting device 101 is arranged at a position closer to the light emitting device 101 than the light-emitting feeding electrodes 103*a* and 103*b*. In particular, the heat generated by the light emitting device 101 is thermally conducted to the substrate 104 via the base 103 and the adhesive agent 105, and radiated from the lower surface of the substrate 104. Therefore, it is possible to reduce the thermal stress applied to the flexible substrates 108 and 109, more than in the case where the substrate 104 as the heat radiation member for radiating the heat generated by the light emitting device 101 is arranged at a position more distant from the light emitting device 101 than the light emitting device feeding electrode 103*a* and 103*b*.

Next, the thirty-third embodiment will be explained, with reference to FIG. 18 and FIG. 19. The lighting fixture of the thirty-third embodiment has almost the same configuration as the lighting fixture of the aforementioned twenty-eighth embodiment, except with respect to the points described below. Therefore, the lighting fixture of the thirty-third embodiment can produce almost the same effect as the lighting fixture of the aforementioned twenty-eighth embodiment, except for certain points described below.

Figure 18:
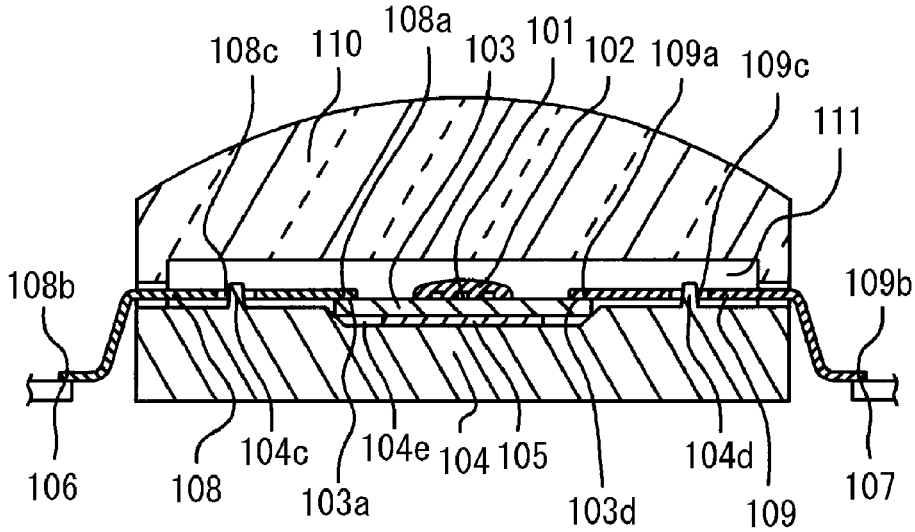
FIG. 18 is a sectional view of a primary portion of a light emitting device module of a lighting fixture according to a thirty-third embodiment.

FIG. 18 is a sectional view of a primary portion of the light emitting device module of the lighting fixture according to the thirty-third embodiment. FIG. 19 is a plan view of the light emitting device module of the lighting fixture according to the thirty-third embodiment in the state where the lens 110 is removed. In particular, FIG. 19 is an illustration of the portion of the light emitting device module of the lighting fixture according to the thirty-third embodiment, when viewing FIG. 18 from the top, in the state where the lens 110 is removed.

As shown in FIG. 15, in the lighting fixture of the twenty-eighth embodiment, the light emitting device feeding electrodes 103*a* and 103*b* are formed on the lower surface of the base 103. On the other hand, in the lighting fixture of the thirty-third embodiment, as shown in FIG. 18, the light emitting device feeding electrodes 103*a* and 103*b* are formed on the upper surface of the base 103.

In the lighting fixture according to the twenty-eighth embodiment, as shown in FIG. 15, the substrate 104 is formed in a convex shape. On the other hand, in the lighting fixture of the thirty-third embodiment, as shown in FIG. 18, the substrate 104 is formed in a concave shape. In particular, in the lighting fixture of the thirty-third embodiment, as shown in FIG. 18 and FIG. 19, the substrate 104 is configured in such a manner that the base 103 is positioned in the concave part 104*e* of the substrate 104.

In the lighting fixture of the thirty-third embodiment, similar to the twenty-eighth embodiment, the external electrodes 106 and 107 are configured in such a manner as to be movable with respect to the light emitting device 101. Alternatively, the external electrodes 106 and 107 can be arranged at positions relatively distant from the light emitting device 101 to such an extent that the temperature of the external electrodes 106 and 107 is not raised, even when the light emitting device 101 generates heat.

The terminals 108*a* and 108*b* of the flexible substrate 108 are respectively connected to the light emitting device feeding electrodes 103*a* and the external electrode 106 by soldering (not illustrated). Alternatively, the terminal 108*a* of the flexible substrate 108 may be connected to the light emitting device feeding electrode 103*a* via the connector (not illustrated), and the terminal 108*b* of the flexible substrate 108 may be connected to the external electrode 106 via the connector (not illustrated) (the thirty-fourth embodiment).

Similarly, the connection of the terminals 109*a* and 109*b* of the flexible substrate 109, respectively with the light emitting device feeding electrode 103*b* and the external electrode 107, may be made by a connector, instead of the solder (the thirty-fifth embodiment).

Figure 19:
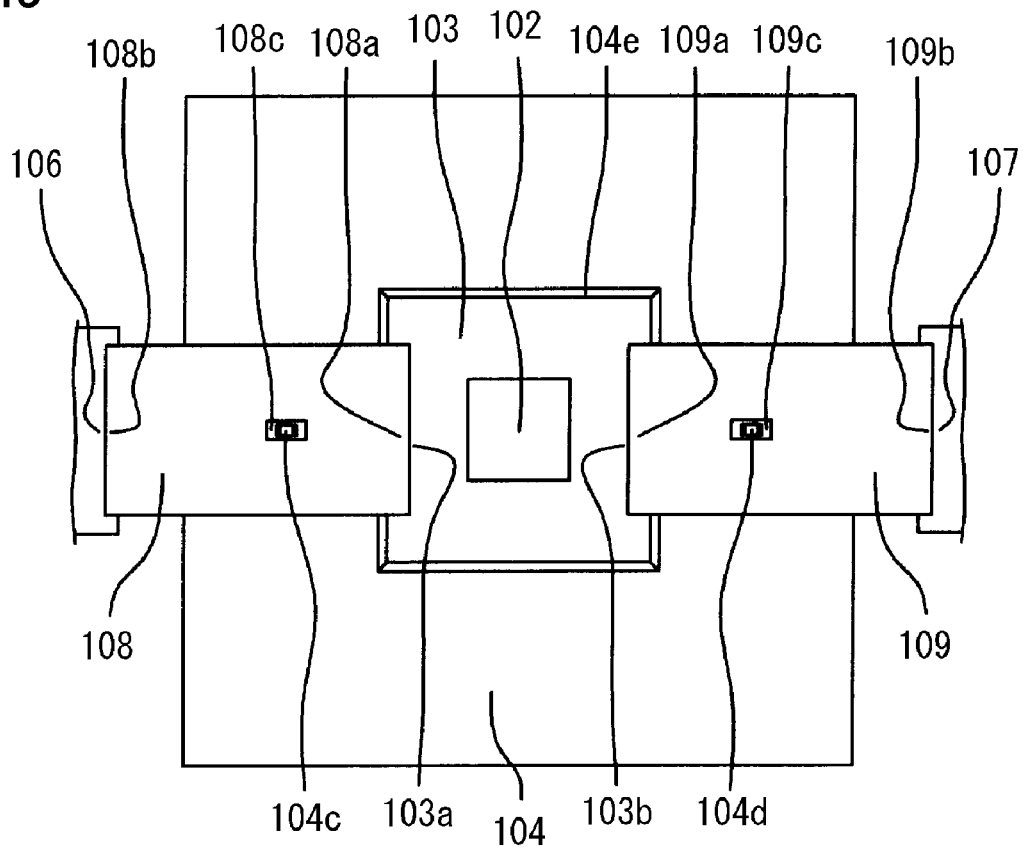
FIG. 19 is a plan view of a portion of the light emitting device module of the lighting fixture according to the thirty-third embodiment, in the state where the lens is removed.

In the lighting fixture of the thirty-third embodiment, as shown in FIG. 18 and FIG. 19, the concave part 104 of the substrate 104 prevents the adhesive agent 105 from flowing out from between the base 103 and the substrate 104 toward the external electrode 106 side (the left side of FIG. 18 and FIG. 19), or toward the external electrode 107 side (the right side of FIG. 18 and FIG. 19). In particular, in the lighting fixture of the thirty-third embodiment, the concave part 104*e* of the substrate 104 is formed so that the adhesive agent 105 reaches neither the light emitting device feeding electrodes 103*a* and 103*b* nor the terminals 108*a* and 109*a* on the upper surface of the base 103.

In the lighting fixture of the thirty-third embodiment, the connection between the light emitting device feeding electrode 103*a* and the external electrode 106, and the connection between the light emitting device feeding electrode 103*b* and the external electrode 107 can be made by using the flexible substrate 108 and the flexible substrate 109, respectively. Instead of the flexible substrate, any connection member, such as a wire and a glass epoxy substrate, may be employed (the thirty-sixth embodiment and the thirty-seventh embodiment).

In the lighting fixture of the thirty-third embodiment, as shown in FIG. 18, the substrate 104 serving as the heat radiation member for radiating the heat generated by the light emitting device 101 is arranged at a position closer to the light emitting device 101, than the light emitting device feeding electrodes 103*a* and 103*b*. In particular, the heat generated by the light emitting device 101 is thermally conducted to the substrate 104 via the base 103 and the adhesive agent 105, and radiated from the lower surface of the substrate 104. Therefore, it is possible to reduce the thermal stress applied to the flexible substrates 108 and 109 more than in the case where the substrate 104 serving as the heat radiation member for radiating the heat generated by the light emitting device 101 is arranged at a position distant from the light emitting device 101, than the light emitting device feeding electrodes 103*a* and 103*b*.

The embodiments from the first to the thirty-seventh as described above may be combined as appropriate.

By way of example, the lighting fixture according to the disclosed subject matter may be applicable to a road lighting, a street light, an indoor lighting, and the like.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A lighting fixture comprising:

a plurality of light emitting device modules each having a light emitting device with an optical axis and fins arranged in parallel to the optical axis of the light emitting device to radiate heat generated by the light emitting device, wherein, the plurality of light emitting device modules are arranged in such a manner that a first main optical axis line of a first of the light emitting device modules and a second main optical axis line of a second of the light emitting device modules form an angle larger than zero degrees with respect to each other, such that the first and second main optical axis lines are displaced in a direction perpendicular to the first and second main optical axis lines, and all the fins are arranged such that the fins are parallel with respect to a vertical plane, and such that all roots of the fins are positioned at a same height as or at a lower height than all tips of the fins, where height is measured along a main optical axis of the lighting fixture.

2. The lighting fixture according to claim 1, wherein, a light distribution pattern of one of the light emitting device modules is formed in an approximately circular shape having a center located at a main optical axis line of the one of the light emitting device modules.

3. The lighting fixture according to claim 2, wherein the light emitting device in each of the light emitting device modules is approximately circular in shape as viewed from a light emitting direction of the light emitting device.

4. The lighting fixture according to claim 2, wherein two or more light emitting devices are arranged about a circle having a center located at a main optical axis line of a respective one of the light emitting device modules.

5. The lighting fixture according to claim 1, wherein the light emitting device includes a covering layer and a heat radiation member, and the covering layer is located on a part of the heat radiating member exposed to air, and the covering layer is not formed on a part of the heat radiation member that is in contact with a thing other than the air.

6. The lighting fixture according to claim 1, wherein the light emitting device includes a heat radiation member that includes a relatively rough surface exposed to air and a relatively non-rough surface on a part of the heat radiation member that is in contact with a thing other than the air.

7. The lighting fixture according to claim 5, wherein the heat radiation member includes a relatively polished surface on a part that is in contact with the something other than the air and a relatively unpolished surface on another surface of the heat radiation member.

8. The lighting fixture according to claim 5, wherein a thermally conductive interface material is located at the part in contact with the thing other than the air on the surface of the heat radiation member.

9. The lighting fixture according to claim 1, wherein the light emitting device of the plurality of the light emitting device modules includes:

a connecting member configured to connect a light emitting device feeding electrode for feeding the light emitting device, with an external electrode, the connecting member being placed within a space and including a first terminal and a second terminal, and the connecting member being constrained in such a manner that the first terminal is connected to the light emitting device feeding electrode, and serves as a fixed end, and the second terminal is configured for connection to the external electrode and serves as a free end.

10. The lighting fixture according to claim 9, wherein, the heat radiation member for radiating heat generated by the light emitting device is located closer to the light emitting device than the light emitting device feeding electrode.

11. The lighting fixture according to claim 10, wherein, an adhesive agent connects the light emitting device onto the heat radiation member, and an anti-running means for preventing the adhesive agent from flowing out from between the light emitting device and the heat radiation member is provided.

12. The lighting fixture according to claim 9, wherein, the connecting member includes a flexible substrate, and the flexible substrate includes a hole configured to guide the flexible substrate toward an external electrode side of the light emitting device.

13. The lighting fixture according to claim 1, wherein the light emitting device of the plurality of the light emitting device modules includes a feeding electrode for feeding power to the light emitting device, and a connecting member configured to connect the feeding electrode with an external electrode, the connecting member being placed within a space and including a first terminal and a second terminal, and the connecting member being constrained in such a manner that the first terminal is connected to the feeding electrode of the light emitting device, and serves as a fixed end, and the second terminal is configured for connection to the external electrode and serves as a free end.

14. The lighting fixture according to claim 13, wherein, the heat radiation member for radiating heat generated by the light emitting device is located closer to the light emitting device than the feeding electrode of the light emitting device.

15. The lighting fixture according to claim 14, wherein, an adhesive agent connects the light emitting device onto the heat radiation member, and the lighting fixture includes anti-running means for preventing the adhesive agent from flowing out from between the light emitting device and the heat radiation member.

16. The lighting fixture according to claim 13, wherein, the connecting member includes a flexible substrate, and the flexible substrate includes a hole configured to guide the flexible substrate toward an external electrode side of the light emitting device.

17. A lighting fixture comprising:

a plurality of light emitting device modules each having a light emitting device having an optical axis and fins arranged in parallel to the optical axis of the light emitting device to radiate heat generated by the light emitting device, wherein, the plurality of light emitting device modules are arranged in such a manner that a first main optical axis line of a first of the light emitting device modules and a second main optical axis line of a second of the light emitting device modules form an angle larger than zero degrees with respect to each other, and a substantial portion of the fins are configured such that the substantial portion of fins are parallel with respect to each other and with respect to a vertical plane, and such that all roots of the substantial portion of the fins are positioned at a same height as or at a lower height than all tips of the substantial portion of the fins, wherein height is measured along a main optical axis of the lighting fixture, and height becomes lower in the light emitting direction of the lighting fixture.

18. The lighting fixture according to claim 17, wherein the light emitting device in each of the light emitting device modules is approximately circular in shape as viewed from a light emitting direction of the light emitting device.

19. The lighting fixture according to claim 17, wherein at least two light emitting devices are arranged about a circle having a center located at a main optical axis line of a respective light emitting device module.

20. The lighting fixture according to claim 17, wherein the light emitting device of the plurality of light emitting device modules includes, a light emitting semiconductor device that includes an electrode terminal, a flexible substrate attached to the electrode terminal of the light emitting semiconductor device, a substrate onto which the light emitting semiconductor device is mounted, and means for allowing the flexible substrate to move relative to the substrate.

* * * * *